US008141656B1

(12) United States Patent
Bertagnolli et al.

(10) Patent No.: US 8,141,656 B1
(45) Date of Patent: Mar. 27, 2012

(54) APPARATUSES AND METHODS RELATING TO COOLING A SUBTERRANEAN DRILL BIT AND/OR AT LEAST ONE CUTTING ELEMENT DURING USE

(75) Inventors: Kenneth E. Bertagnolli, Sandy, UT (US); Scott M. Schmidt, Draper, UT (US)

(73) Assignee: US Synthetic Corporation, Orem, UT (US)

( * ) Notice: Subject to any disclaimer, the term of this patent is extended or adjusted under 35 U.S.C. 154(b) by 0 days.

(21) Appl. No.: 12/353,818

(22) Filed: Jan. 14, 2009

Related U.S. Application Data

(63) Continuation of application No. 11/279,476, filed on Apr. 12, 2006, now Pat. No. 7,493,965.

(51) Int. Cl.
*E21B 10/38* (2006.01)
*E21B 36/00* (2006.01)

(52) U.S. Cl. ..... 175/17; 175/425

(58) Field of Classification Search ..... 175/17, 175/57, 327, 425
See application file for complete search history.

(56) References Cited

U.S. PATENT DOCUMENTS

| | | | |
|---|---|---|---|
| 1,554,697 | A | 9/1925 | Alden |
| 1,870,696 | A | 8/1932 | Taylor |
| 2,861,780 | A | 11/1958 | Butler |
| 3,303,900 | A | 2/1967 | Kloesel, Jr. et al. |
| 3,311,956 | A | 4/1967 | Townsend et al. |
| 3,612,192 | A | 10/1971 | Maguire, Jr. |
| 3,645,491 | A | 2/1972 | Brown et al. |
| 3,650,337 | A | 3/1972 | Andrews et al. |
| 3,745,623 | A | 7/1973 | Wentorf, Jr. et al. |
| 3,825,080 | A | 7/1974 | Short |
| 3,903,951 | A | 9/1975 | Kaneko et al. |
| 3,935,911 | A | 2/1976 | McQueen |
| 3,964,534 | A | 6/1976 | Rabinowitz |
| 3,964,554 | A | 6/1976 | Ricks et al. |
| 4,073,354 | A | 2/1978 | Rowley et al. |
| 4,287,957 | A | 9/1981 | Evans |
| 4,441,930 | A | 4/1984 | Baudis et al. |
| 4,452,324 | A | 6/1984 | Jurgens |
| 4,554,962 | A | 11/1985 | Wright |
| 4,667,756 | A | 5/1987 | King et al. |
| 4,743,481 | A | 5/1988 | Quinlan et al. |
| 4,802,525 | A | 2/1989 | Heine et al. |
| 4,852,671 | A | 8/1989 | Southland |
| 4,913,247 | A | 4/1990 | Jones |
| 4,919,013 | A | 4/1990 | Smith et al. |

(Continued)

FOREIGN PATENT DOCUMENTS

| | | |
|---|---|---|
| EP | 0815995 | 1/1998 |

(Continued)

*Primary Examiner* — Cathleen Hutchins
(74) *Attorney, Agent, or Firm* — Holland & Hart, LLP

(57) ABSTRACT

One aspect of the instant disclosure relates to a subterranean drilling assembly comprising a subterranean drill bit and a sub apparatus coupled to the drill bit. Further, the sub apparatus may include at least one cooling system configured to cool at least a portion of the drill bit. For example, the sub apparatus may include at least one cooling system comprising a plurality of refrigeration coils or at least one thermoelectric device. In another embodiment a subterranean drill bit may include at least one cooling system positioned at least partially within the subterranean drill bit. Also, a sub apparatus or subterranean drill bit may be configured to cool drilling fluid communicated through at least one bore of a subterranean drill bit and avoiding cooling drilling fluid communicated through at least another bore of the subterranean drill bit. Methods of operating a subterranean drill bit are disclosed.

15 Claims, 19 Drawing Sheets

U.S. PATENT DOCUMENTS

| | | | |
|---|---|---|---|
| 5,028,177 | A | 7/1991 | Meskin et al. |
| 5,126,089 | A | 6/1992 | Johnson et al. |
| 5,303,785 | A | 4/1994 | Duke |
| 5,316,095 | A | 5/1994 | Tibbitts |
| 5,373,907 | A | 12/1994 | Weaver |
| 5,435,403 | A | 7/1995 | Tibbitts |
| 5,544,550 | A | 8/1996 | Smith |
| 5,590,729 | A | 1/1997 | Cooley et al. |
| 5,598,621 | A | 2/1997 | Littecke et al. |
| 5,662,183 | A | 9/1997 | Fang |
| 6,410,085 | B1 | 6/2002 | Griffin et al. |
| 6,435,058 | B1 | 8/2002 | Matthias et al. |
| 6,481,511 | B2 | 11/2002 | Matthias et al. |
| 6,544,308 | B2 | 4/2003 | Griffin et al. |
| 6,562,462 | B2 | 5/2003 | Griffin et al. |
| 6,585,064 | B2 | 7/2003 | Griffin et al. |
| 6,589,640 | B2 | 7/2003 | Griffin et al. |
| 6,592,985 | B2 | 7/2003 | Griffin et al. |
| 6,601,662 | B2 | 8/2003 | Matthias et al. |
| 6,655,234 | B2 | 12/2003 | Scott |
| 6,659,204 | B2 | 12/2003 | Aumann et al. |
| 6,739,214 | B2 | 5/2004 | Griffin et al. |
| 6,749,033 | B2 | 6/2004 | Griffin et al. |
| 6,797,236 | B2 | 9/2004 | Stoschek |
| 6,861,098 | B2 | 3/2005 | Griffin et al. |
| 6,861,137 | B2 | 3/2005 | Griffin et al. |
| 6,878,447 | B2 | 4/2005 | Griffin et al. |
| 7,000,711 | B2 | 2/2006 | Miller et al. |
| 2004/0104050 | A1 | 6/2004 | Jarvela et al. |
| 2006/0162931 | A1 | 7/2006 | Mayes |
| 2007/0079991 | A1 | 4/2007 | Cooley et al. |

FOREIGN PATENT DOCUMENTS

| | | |
|---|---|---|
| GB | 2236699 | 4/1991 |
| GB | 2268527 | 1/1994 |
| GB | 2278558 | 12/1994 |
| GB | 2296880 | 7/1996 |
| GB | 2318993 | 5/1998 |
| GB | 2318994 | 5/1998 |
| WO | WO 97/29885 | 8/1997 |
| WO | WO 98/13317 | 4/1998 |
| WO | WO 00/05063 | 2/2000 |

APPARATUSES AND METHODS RELATING TO COOLING A SUBTERRANEAN DRILL BIT AND/OR AT LEAST ONE CUTTING ELEMENT DURING USE

RELATED APPLICATION

This is a continuation of U.S. patent application Ser. No. 11/279,476, filed on 12 Apr. 2006, the disclosure of which is incorporated, in its entirety, by this reference, now pending.

BACKGROUND

Wear resistant compacts or elements comprising polycrystalline diamond are utilized for a variety of uses and in a corresponding variety of mechanical systems. For example, wear resistant elements are used in drilling tools, machining equipment, bearing apparatuses, wire drawing machinery, and in other mechanical systems. For example, it has been known in the art for many years that polycrystalline diamond ("PDC") compacts, when used as cutters, perform well on drag bits. A PDC cutter typically has a diamond layer or table formed under high temperature and pressure conditions and bonded to a substrate (such as cemented tungsten carbide) containing a metal binder or catalyst such as cobalt. The substrate may be brazed or otherwise joined to an attachment member such as a stud or to a cylindrical backing element to enhance its affixation to the bit face. The cutting element may be mounted to a drill bit either by press-fitting or otherwise locking the stud into a receptacle on a steel-body drag bit, or by brazing the cutter substrate (with or without cylindrical backing) directly into a preformed pocket, socket or other receptacle on the face of a bit body, as on a matrix-type bit formed of tungsten carbide particles cast in a solidified, usually copper-based, binder as known in the art. Thus, polycrystalline diamond compacts or inserts or cutting elements often form at least a portion of a cutting structure of a subterranean drilling or boring tools; including drill bits (e.g., fixed cutter drill bits, roller cone drill bits, etc.) reamers, and stabilizers. Such tools, as known in the art, may be used in exploration and production relative to the oil and gas industry. A variety of polycrystalline diamond compacts and inserts are known in the art.

A PDC typically includes a diamond layer or table formed by a sintering process employing high temperature and high pressure conditions that causes the diamond table to become bonded or affixed to a substrate (such as cemented tungsten carbide substrate). More particularly, a PDC is normally fabricated by placing a cemented carbide substrate into a container or cartridge with a layer of diamond crystals or grains positioned adjacent one surface of the substrate. A number of such cartridges may be typically loaded into an ultra-high pressure press. The substrates and adjacent diamond crystal layers are then sintered under ultra-high temperature and ultra-high pressure ("HPHT") conditions. The HPHT conditions cause the diamond crystals or grains to bond to one another to form polycrystalline diamond. In addition, as known in the art, a catalyst may be employed for facilitating formation of polycrystalline diamond. In one example, a so-called "solvent catalyst" may be employed for facilitating the formation of polycrystalline diamond. For example, cobalt, nickel, and iron are among solvent catalysts for forming polycrystalline diamond. In one configuration, during sintering, solvent catalyst comprising the substrate body (e.g., cobalt from a cobalt-cemented tungsten carbide substrate) becomes liquid and sweeps from the region adjacent to the diamond powder and into the diamond grains. Of course, a solvent catalyst may be mixed with the diamond powder prior to sintering, if desired. Also, as known in the art, such a solvent catalyst may dissolve carbon. Such carbon may be dissolved from the diamond grains or portions of the diamond grains that graphitize due to the high temperatures of sintering. The solubility of the stable diamond phase in the solvent catalyst is lower than that of the metastable graphite under high-pressure, high temperature ("HPHT") conditions. As a result of this solubility difference, the undersaturated graphite tends to dissolve into solution; and the supersaturated diamond tends to deposit onto existing nuclei to form diamond-to-diamond bonds. Thus, diamond grains become mutually bonded to form a polycrystalline diamond table upon the substrate. The solvent catalyst may remain in the polycrystalline diamond layer within the interstitial pores between the diamond grains or the solvent catalyst may be at least partially removed from the polycrystalline diamond, as known in the art. For instance, the solvent catalyst may be at least partially removed from the polycrystalline diamond by acid leaching. A conventional processes for forming polycrystalline diamond cutters is disclosed in U.S. Pat. No. 3,745,623 to Wentorf, Jr. et al., the disclosure of which is incorporated herein, in its entirety, by this reference. Optionally, another material may replace the solvent catalyst that has been at least partially removed from the polycrystalline diamond.

Thus, during the HPHT sintering process, a skeleton or matrix of diamond is formed through diamond-to-diamond bonding between adjacent diamond particles. Further, relatively small pore spaces or interstitial spaces may be formed within the diamond structure, which may be filled with the solvent catalyst. Because the solvent catalyst exhibits a much higher thermal expansion coefficient than the diamond structure, the presence of such solvent catalyst within the diamond structure is believed to be a factor leading to premature thermal mechanical damage. Accordingly, as the PCD reaches temperatures exceeding about 400° Celsius, the differences in thermal expansion coefficients between the diamond and the solvent catalyst may cause diamond bonds to fail. Of course, as the temperature increases, such thermal mechanical damage may be increased. In addition, as the temperature of the PCD layer approaches 750° Celsius, a different thermal mechanical damage mechanism may initiate. At approximately 750° Celsius or greater, the solvent catalyst may chemically react with the diamond causing graphitization of the diamond. This phenomenon may be termed "back conversion," meaning conversion of diamond to graphite. Such conversion from diamond to graphite may cause dramatic loss of wear resistance in a polycrystalline diamond compact and may rapidly lead to insert failure.

Thus, it would be advantageous to provide systems for transferring heat from a cutting element or wear element comprising polycrystalline diamond during use. In addition, it would be advantageous to provide a subterranean drill bit and/or apparatuses for use therewith that may cool or otherwise transfer heat from at least a portion of the subterranean drill bit.

SUMMARY

The present invention relates generally to cooling a cutting element (e.g., a polycrystalline diamond cutting element) during use. In one example, a cutting element may be affixed to a subterranean drill bit. The present invention contemplates that aspects of the present invention may be incorporated within any variety of earth-boring tools, or drilling tools, including, for example, core bits, roller-cone bits, fixed-cutter bits, eccentric bits, bicenter bits, reamers, reamer wings, or any other downhole tool including at least one cutting element or insert, without limitation. Further, the present invention contemplates that systems or methods for machining, cutting, or other material-removal systems or methods may incorporate aspects of the present invention.

One aspect of the present invention relates generally to preferentially cooling a subterranean drill bit. Generally, a sub apparatus may be coupled to or at least positioned proximate to a subterranean drill bit and may be configured to facilitate cooling of the subterranean drill bit. At least one closed refrigeration system, at least one thermoelectric device, or other cooling devices or systems as known in the art may be employed for preferentially cooling at least a portion of a subterranean drill bit. In one embodiment, at least one cutting element (e.g., at least one polycrystalline diamond cutting element or compact) may be preferentially cooled. Such a configuration may inhibit or prevent occurrence of thermal damage to the at least one cutting element.

One aspect of the instant disclosure relates to a subterranean drilling assembly comprising a subterranean drill bit and a sub apparatus coupled to the subterranean drill bit. Further, the sub apparatus may include at least one cooling system configured to cool at least a portion of the subterranean drill bit. For example, the sub apparatus may include at least one cooling system comprising a plurality of refrigeration coils or at least one thermoelectric device.

Another aspect of the present invention relates to a subterranean drilling assembly comprising a subterranean drill bit, wherein the subterranean drill bit includes at least one cooling system positioned at least partially within the subterranean drill bit and configured to cool at least one cutting element affixed to the subterranean drill bit. In addition, a sub apparatus may be coupled to the subterranean drill bit, wherein the sub apparatus is configured to facilitate operation of the at least one cooling system.

A further aspect of the present invention relates to a drilling assembly comprising a bit body defining a plurality of central bores configured to communicate drilling fluid and a sub apparatus coupled to the subterranean drill bit. In further detail, the sub apparatus may be configured to cool drilling fluid to be communicated through at least one of the plurality of central bores of the subterranean drill bit while avoiding cooling drilling fluid to be communicated through at least another of the plurality of central bores of the subterranean drill bit.

An additional aspect of the present invention relates to a subterranean drill bit comprising a bit body defining a plurality of passageways configured to communicate drilling fluid and at least one cooling system positioned at least partially within the subterranean drill bit. Further, the at least one cooling system may be structured to cool drilling fluid flowing through at least one of the plurality of passageways while avoiding cooling of drilling fluid flowing through at least another of the plurality of passageways.

Yet another aspect of the present invention relates to a method of operating a subterranean drill bit. Particularly, a subterranean drill bit may be provided, wherein the subterranean drill bit includes a plurality of central bores configured to communicate drilling fluid. Further, a cooled drilling fluid may flow through at least one of the plurality of central bores, while an uncooled drilling fluid flows through at least another of the plurality of central bores.

Also, the present invention relates to a method of operating a subterranean drill bit, wherein a subterranean drill bit may be provided including at least one passageway configured to communicate a drilling fluid. Further, the drilling fluid may be cooled proximate to the subterranean drill bit and flowed through the subterranean drill bit.

Features from any of the above mentioned embodiments may be used in combination with one another, without limitation. In addition, other features and advantages of the instant disclosure will become apparent to those of ordinary skill in the art through consideration of the ensuing description, the accompanying drawings, and the appended claims.

BRIEF DESCRIPTION OF THE DRAWINGS

Further features of the subject matter of the instant disclosure, its nature, and various advantages will be more apparent from the following detailed description and the accompanying drawings, which illustrate various exemplary embodiments, are representations, and are not necessarily drawn to scale, wherein.

DETAILED DESCRIPTION

The present invention relates generally to cooling a subterranean drilling tool. More particularly, the present invention contemplates that a subterranean drilling tool may include a cooling apparatus configured for removing heat from a subterranean drill bit. In one embodiment, heat may be removed from a subterranean drill bit via conduction through a threaded pin connection.

Figure 1:
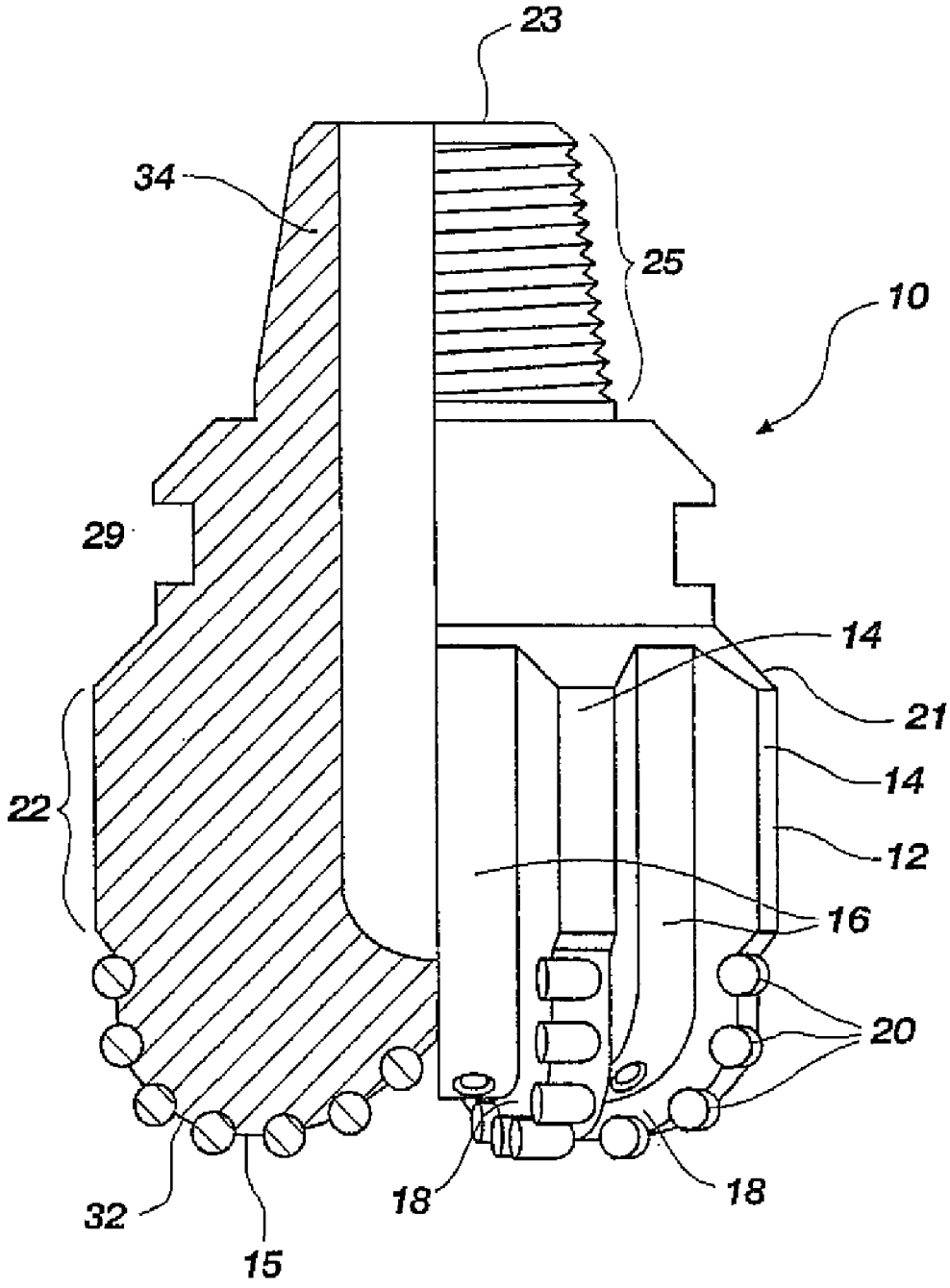
FIG. 1 shows a partially sectioned side view of a subterranean drill bit.

For example, a subterranean drill bit 10 is illustrated in FIG. 1 in a partially sectioned side view. The subterranean drill bit 10 may include, generally, a bit body 12 including a plurality of protruding or extending blades 14 defining junk slots 16 between the blades 14. Each blade 14 may define a leading cutting face 18 (or envelope, upon rotation of the subterranean drill bit 10). Generally, the cutting face 18 may extend from proximate the center of the subterranean drill bit 10 around the distal end 15 of the subterranean drill bit 10, and may include a plurality of cutting elements 20 oriented to cut into a subterranean formation upon rotation of the drill bit 10. The cutting elements 20 are secured to and supported by the blades 14 along a selected profile 32, as known in the art. Between the uppermost of the cutting elements 20 and the top edge 21 of the blade 14, each blade 14 defines a gage region 22 that corresponds generally to the largest-diameter portion of the drill bit 10 and thus, may be typically only slightly smaller than the diameter of the hole to be drilled by cutting elements 20 of the bit 10. A coupling end 23 of the bit 10 includes a threaded portion or pin 25 to threadedly attach the subterranean drill bit 10 to other drilling equipment (e.g., a drill collar, a downhole motor, etc.), as is known in the art. In one example, the threaded pin portion 25 (e.g., a tapered API-type thread) may be machined directly into the coupling end 23 of the subterranean drill bit 10, as known in the art.

During use, it may be appreciated that cutting elements 20 may generate heat. One aspect of the present invention contemplates that heat may be removed from a drill bit via a near-bit cooling apparatus. More particularly, in one embodiment, a near-bit apparatus may cool a coupling structure attached to the drill bit. Thus, heat may be removed from a subterranean drill bit through a coupling surface of the subterranean drill bit.

Figure 2:
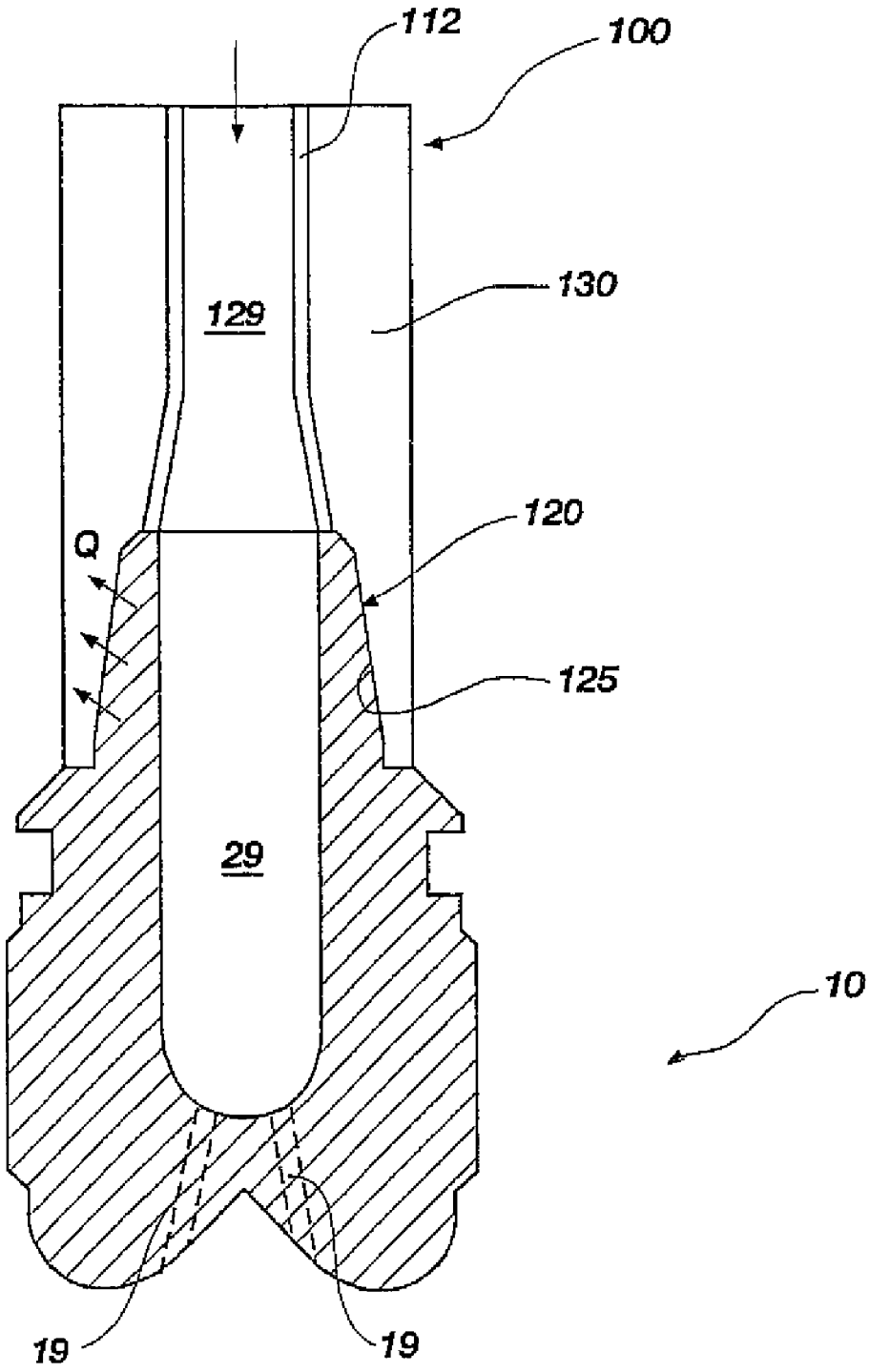
FIG. 2 shows a schematic, side cross-sectional view of one embodiment of a subterranean drilling assembly according to the present invention.

For example, FIG. 2 shows a schematic, side cross-sectional view of an assembly including subterranean drill bit 10 and sub apparatus 100. As shown in FIG. 2, sub apparatus 100 and subterranean drill bit 10 are coupled to one another generally at coupling end 23 (FIG. 1) of subterranean drill bit 10. More particularly, sub coupling surface 120 and drill bit coupling surface 125 may be proximate to one another or may at least partially contact or abut one another, without limitation. Further, sub apparatus 100 may be cooled so that heat (labeled "Q" in FIG. 2) may be transferred from subterranean drill bit 10 to sub apparatus 100 by conduction. Optionally, a material structured or formulated to facilitate heat transfer between drill bit coupling surface 125 and sub coupling surface 120 may be positioned between drill bit coupling surface 125 and sub coupling surface 120. For example, if drill bit coupling surface 125 and sub coupling surface 120 comprise threaded surfaces, a lubricant (e.g., grease or another lubricant as known in the art) that is enhanced to facilitate thermal conductivity (e.g., via particles with a relatively high thermal conductivity, such as, for instance, copper, graphite, aluminum, mixtures of the foregoing, or otherwise structured or formulated for facilitating heat transfer) may be positioned between drill bit coupling surface 125 and sub coupling surface 120. In one embodiment, the present invention contemplates that sub body 130 may exhibit a temperature that is less, than or greater than a temperature of drilling fluid passing through sub bore 129. Therefore, optionally, as shown in FIG. 2, an insulative material 112 may define sub bore 129 and may be structured to impede or avoid heat transfer between a drilling fluid flowing through sub bore 129 and sub body 130. Such a configuration may allow for cooling of the subterranean drill bit 10 as opposed to cooling a drilling fluid passing through sub bore 129. One of ordinary skill in the art will understand that an insulative material 112, as shown in FIG. 2, may be included within any of the embodiments discussed below, without limitation. Thus, during operation, drilling fluid may flow through sub bore 129, into subterranean drill bit bore 29, and passages 19, which may include nozzles, each nozzle having an opening of a selective size. In summary, sub apparatus 100 may provide beneficial cooling to subterranean drill bit 10. More specifically, at least one cutting element affixed to subterranean drill bit 10 may exhibit a lower temperature during use than a conventional drilling assembly during use.

Further, generally, if at least one cutting element affixed to subterranean drill bit 10 comprises polycrystalline diamond, cooling such a polycrystalline diamond cutting element or any other superabrasive cutting element may reduce or inhibit thermal damage associated with drilling a subterranean formation. For example, in one embodiment, a cooling system for cooling at least one cutting element (e.g., a polycrystalline diamond cutting element) may be configured to maintain a temperature of the at least one cutting element below about 400° Celsius. In another embodiment, a cooling system for cooling at least one cutting element (e.g., a polycrystalline diamond cutting element) may be configured to maintain a temperature of the at least one cutting element below about 750° Celsius. One of ordinary skill in the art will appreciate that any apparatus or system discussed herein may be configured for maintaining the above-mentioned temperatures, without limitation.

Figure 3:
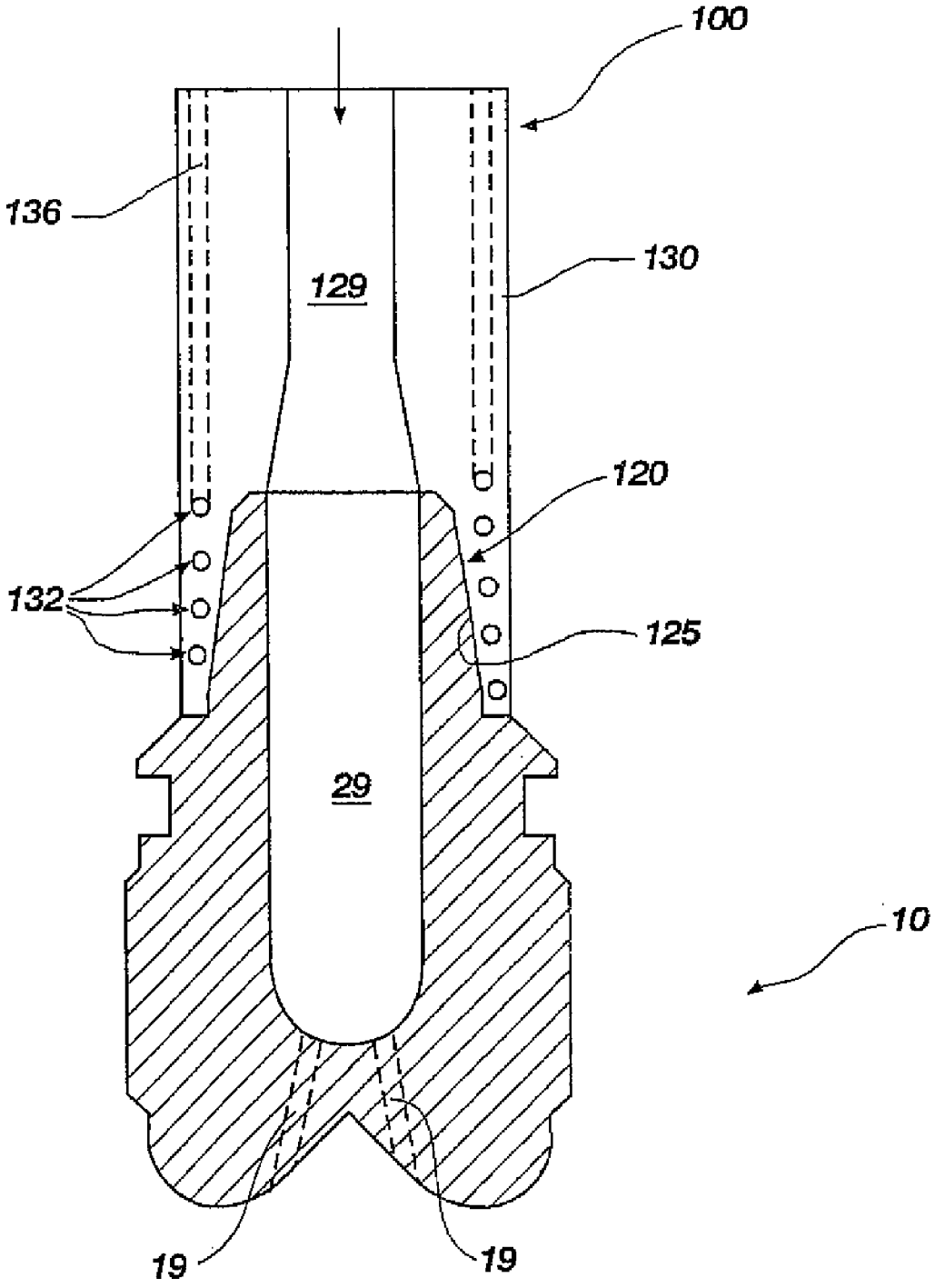
FIG. 3 shows a schematic, side cross-sectional view of another embodiment of a subterranean drilling assembly according to the present invention.
Figure 4:
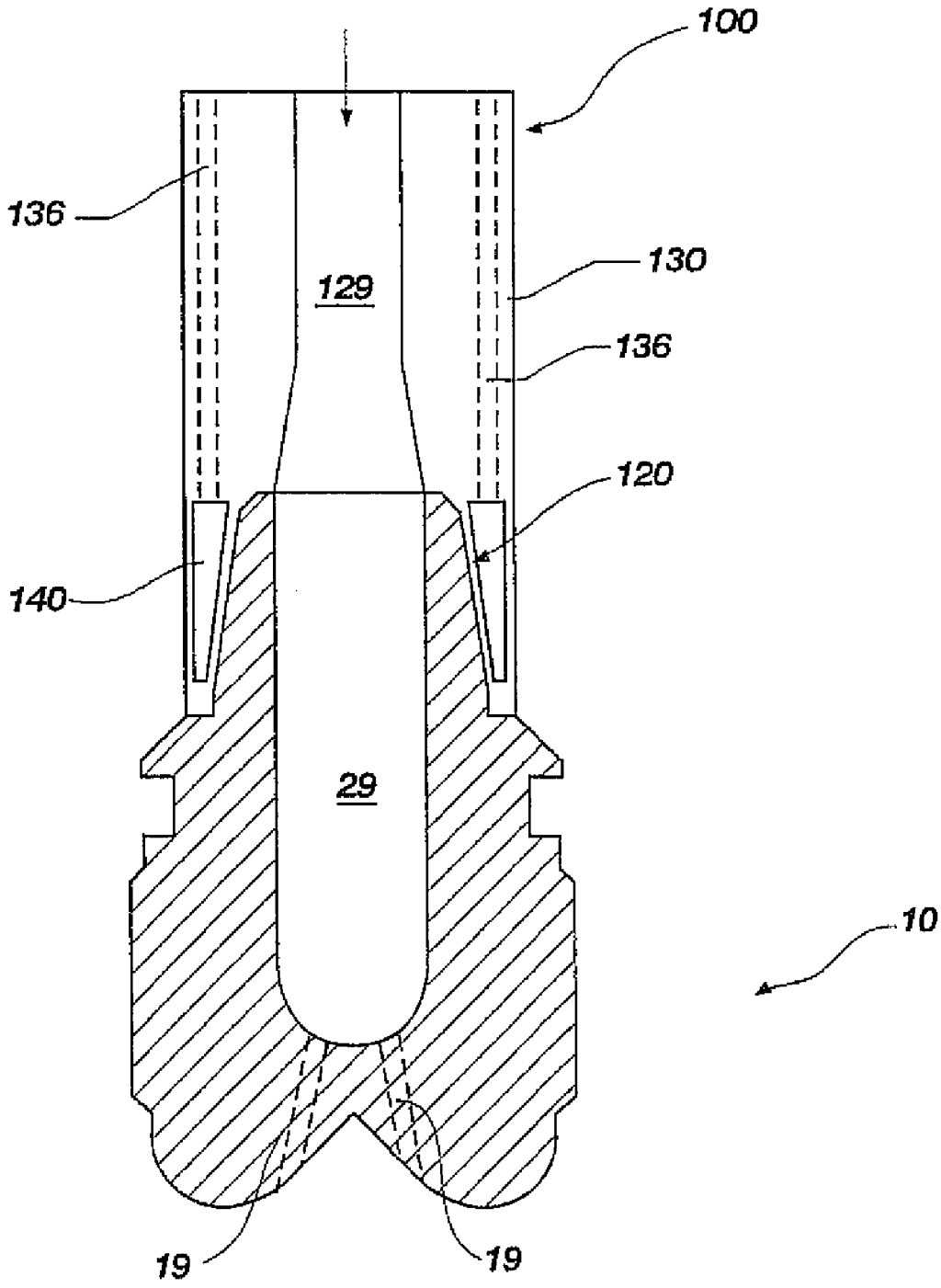
FIG. 4 shows a schematic, side cross-sectional view of a further embodiment of a subterranean drilling assembly according to the present invention.

The present invention contemplates that sub apparatus 100 may be cooled by a variety of technologies, taken alone or in combination. For example, a closed refrigeration system may be included within at least a portion of sub apparatus 100. For example, FIG. 3 shows a schematic, side cross-sectional view of an assembly including a sub apparatus 100 coupled to a subterranean drill bit 10, wherein sub apparatus 100 includes refrigeration coils 132 positioned proximate to drill bit coupling surface 125 and sub coupling surface 120. Further, refrigeration coils 132 may contain a refrigerant and may be operably coupled to a refrigeration system including a compressor and an expansion valve, without limitation. Such a configuration may enable removal of heat from subterranean bit 10 through drill bit coupling surface 125 and sub coupling surface 120. As may be appreciated, suitable refrigerants, compressors, expansion valves, and operating conditions may be selected in relation to characteristics of the subterranean drill bit 10 as well as drilling conditions (e.g., the formation being drilled, ambient temperature, ambient pressure, drilling fluid flow rates, etc.). In another embodiment, a sub apparatus may include a plenum for circulating a refrigerant, wherein the plenum is positioned proximate to a drill bit coupling surface and a sub coupling surface. For instance, FIG. 4 shows a schematic, side cross-sectional view of an assembly including a subterranean drill bit 10 and a sub apparatus 100, wherein the sub apparatus 100 includes a refrigerant plenum 140. Thus, during operation, a refrigerant (e.g., ammonia, chlorofluorocarbons, or any other refrigerant as known in the art) may be circulated through refrigerant lines 136 that are operably coupled to a refrigerant system, as discussed above. Such a configuration may be relatively easy to manufacture and may be relatively efficient in removing heat from subterranean drill bit 10.

Figure 5A:
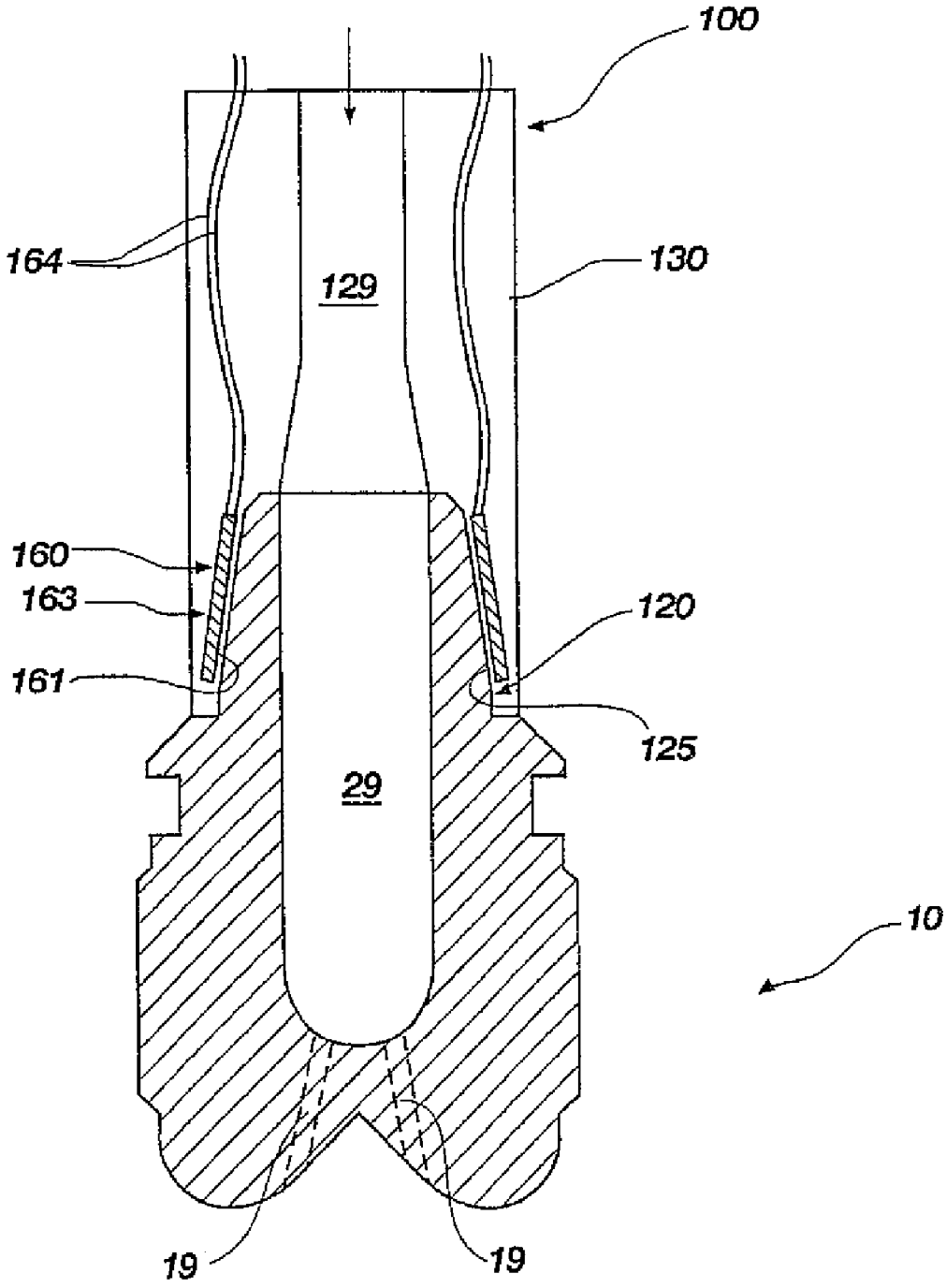
FIG. 5A shows a schematic, side cross-sectional view of yet another embodiment of a subterranean drilling assembly according to the present invention.

In another embodiment, the present invention contemplates that a sub apparatus may include at least one thermoelectric device structured for removing heat from a subterranean drill bit. More specifically, in one embodiment, at least one thermoelectric device may be positioned proximate a sub coupling surface of a sub apparatus. For example, FIG. 5A shows a schematic, side cross-sectional view of an assembly including a subterranean drill bit 10 and a sub apparatus 100, wherein sub apparatus 100 comprises a thermoelectric device 160 positioned proximate to a sub coupling surface 120. Thermoelectric device 160 may comprise any device that operates by way of the Peltier effect, without limitation. Thus, thermoelectric device 160 may transfer heat between a cooled surface 161 and a heat-expelling surface 163 in response to a voltage applied to at least one thermocouple junction via electrical conduits 164. Further, one of ordinary skill in the art will appreciate that at least one thermoelectric device 160 may substantially surround sub coupling surface 120. Accordingly, in one embodiment, thermoelectric device 160 may be annularly shaped. In another embodiment, thermoelectric device 160 may comprise a plurality of substantially planar or arcuately-shaped thermoelectric devices, which are positioned circumferentially adjacent to one another about sub coupling surface 120. The at least one thermoelectric device 160 may be configured for providing selected cooling (e.g., uneven or substantially uniform cooling) about sub coupling surface 120, if desired, without limitation.

Figure 5B:
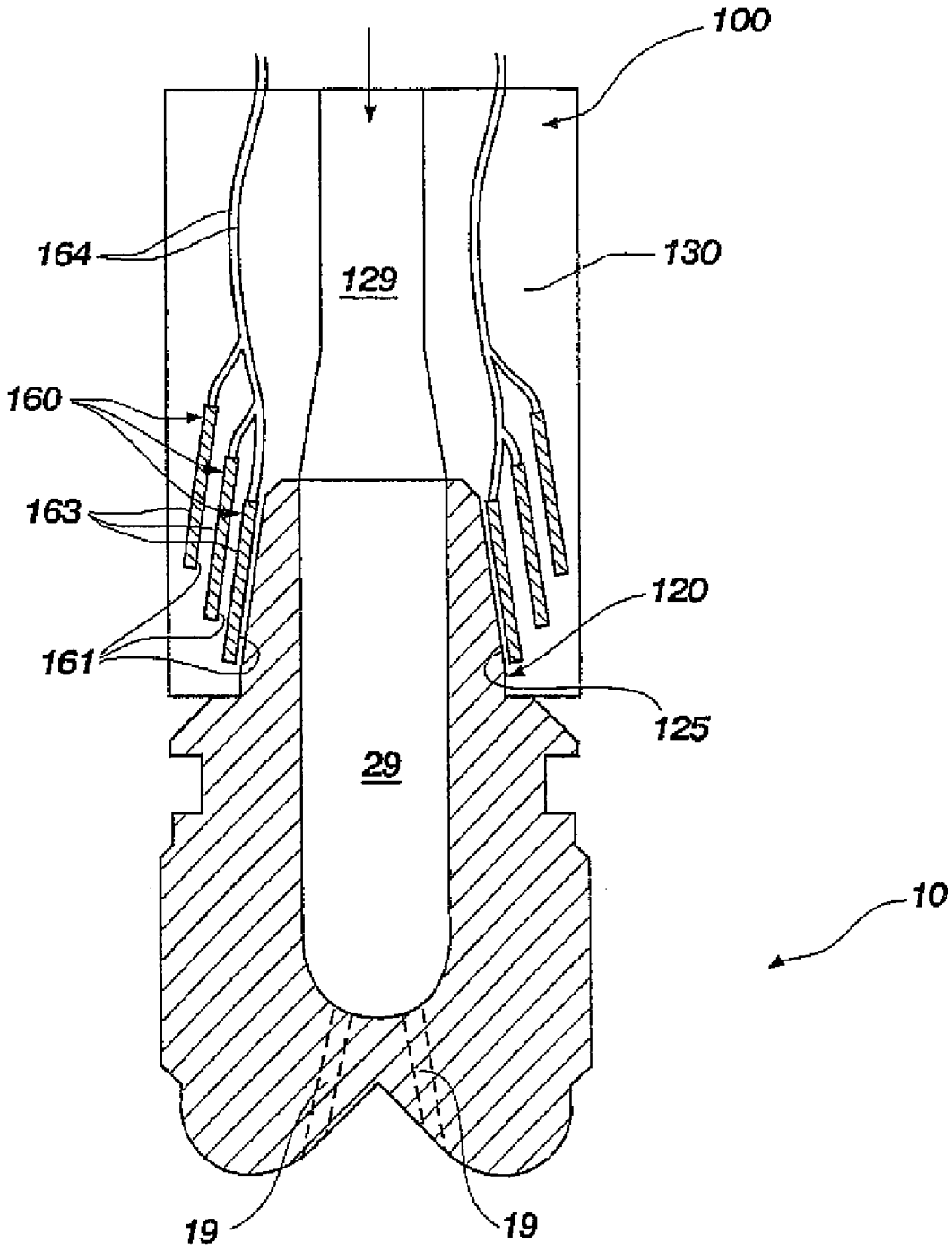
FIG. 5B shows a schematic, side cross-sectional view of an embodiment of a subterranean drilling assembly including a plurality of thermoelectric devices according to the present invention.

Further, one of ordinary skill in the art will appreciate that a plurality of thermoelectric devices could be arranged to transfer heat from a selected region of a subterranean drill bit. For example, FIG. 5B shows a schematic, side cross-sectional view of an assembly including a subterranean drill bit 10 and a sub apparatus 100, wherein sub apparatus 100 comprises a plurality of thermoelectric devices 160. As shown in FIG. 5B, heat expelling surfaces 163 are adjacent to respective cooled surfaces 161 of adjacent thermoelectric devices 160. Thus, thermoelectric devices 160 may transfer heat between a cooled surfaces 161 and heat-expelling surfaces 163 and generally from sub coupling surface 120. Put another way, a heat-expelling surface 163 of one thermoelectric device 160 is positioned adjacent to a cooled surface 161 of a next sequential thermoelectric device 160 (and so on) such that heat from sub coupling surface 120 is transferred through a series (or plurality) of thermoelectric devices 160. One of ordinary skill in the art will appreciate that, in one embodiment, the plurality of thermoelectric devices 160 may substantially surround sub coupling surface 120. Further, thermoelectric devices 160 may be annularly shaped, substantially planar, or arcuately-shaped, without limitation. Thermoelectric devices 160 may be configured for providing selected cooling (e.g., uneven or substantially uniform cooling) about sub coupling surface 120, if desired, without limitation.

Figure 6:
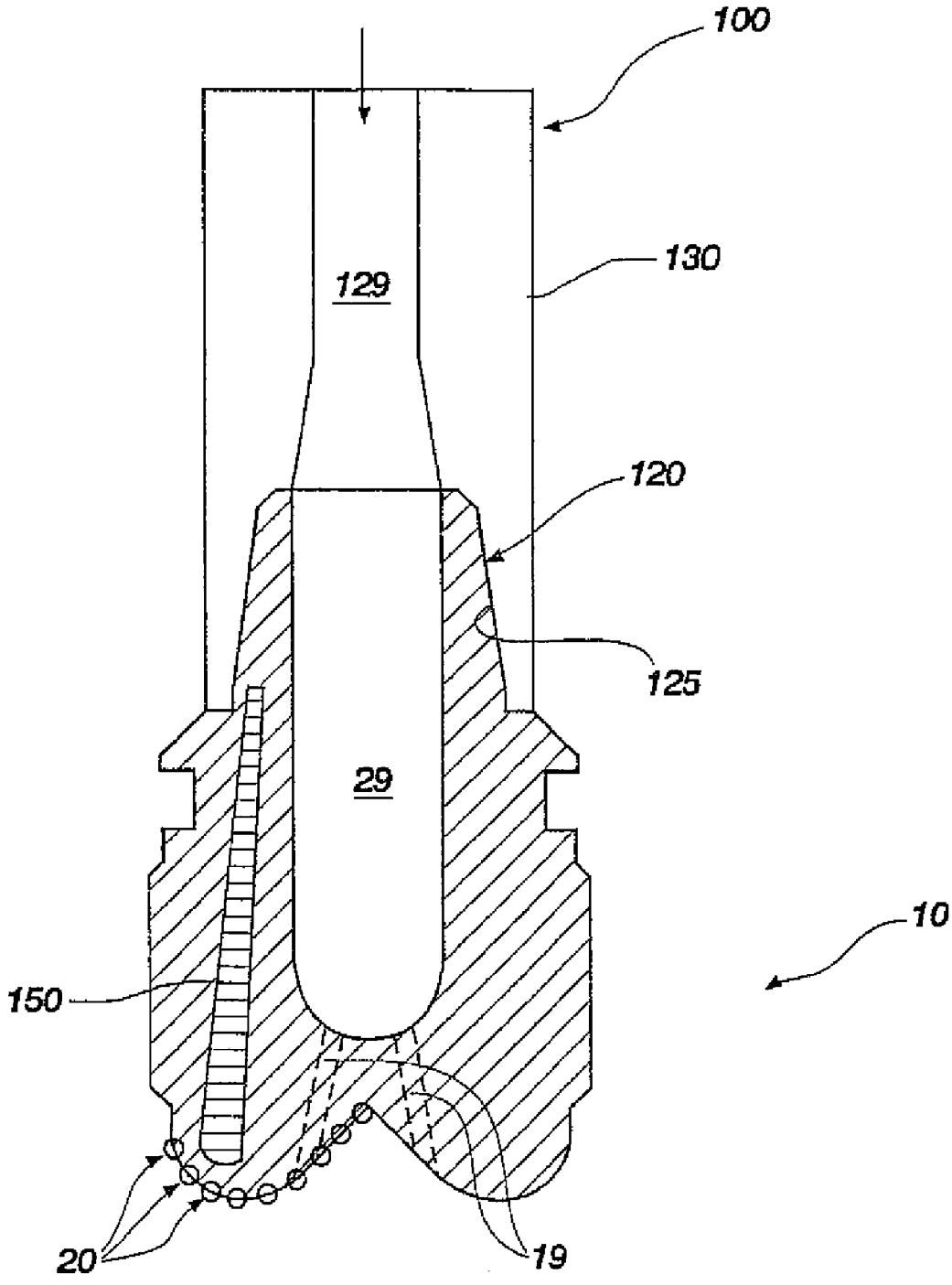
FIG. 6 shows a schematic, side cross-sectional view of an embodiment of a subterranean drilling assembly, wherein the subterranean drill bit includes at least one heat-conducting structure.

The present invention further contemplates that a subterranean drill bit may include at least one heat-conducting structure. More particularly, the present invention contemplates that a heat-conducting structure may extend from proximate a drill bit coupling surface to proximate at least one cutting element affixed to the subterranean drill bit. For example, FIG. 6 shows a schematic, side cross-sectional view of a subterranean drill bit 10 including a heat-conducting element 150 extending from proximate to drill bit coupling surface 125 to proximate at least one of cutting elements 20. Heat-conducting element 150 may comprise a material exhibiting a relatively high thermal conductivity. For example, heat-conducting element 150 may comprise copper, gold, silver, aluminum, tungsten, graphite or carbon, titanium, zirconium, molybdenum, or mixtures or alloys of the foregoing, without limitation. Generally, heat-conducting element 150 may comprise a material exhibiting a thermal conductivity that exceeds a thermal conductivity of material comprising subterranean drill bit 10. Further, heat-conducting element 150 may comprise a heat pipe or thermosyphon system. Such a configuration may transport heat via an evaporation-condensation cycle which is facilitated by porous capillaries (heat pipe) or gravity (thermosyphon) to return condensate to the evaporator. Accordingly, such an evaporation-condensation cycle may transfer large quantities of heat with relatively low or moderate heat gradients. In addition, a heat pipe may be very reliable and may have a long working life, because operation of a heat pipe is passive and is driven by the heat transferred through the heat pipe.

Thus, according to any of the above-described embodiments, heat may be preferentially transferred via heat-conducting element 150 from proximate at least one cutting element 20 into other regions of drill bit 10 or from subterranean drill bit 10 through drill bit coupling surface 125. Any of the above-discussed systems for removing heat from subterranean drill bit 10 (e.g., refrigeration systems, thermoelectric devices, or other cooling technologies) may be employed for removing heat from subterranean drill bit 10 through at least one heat-conducting element 150.

Figure 7:
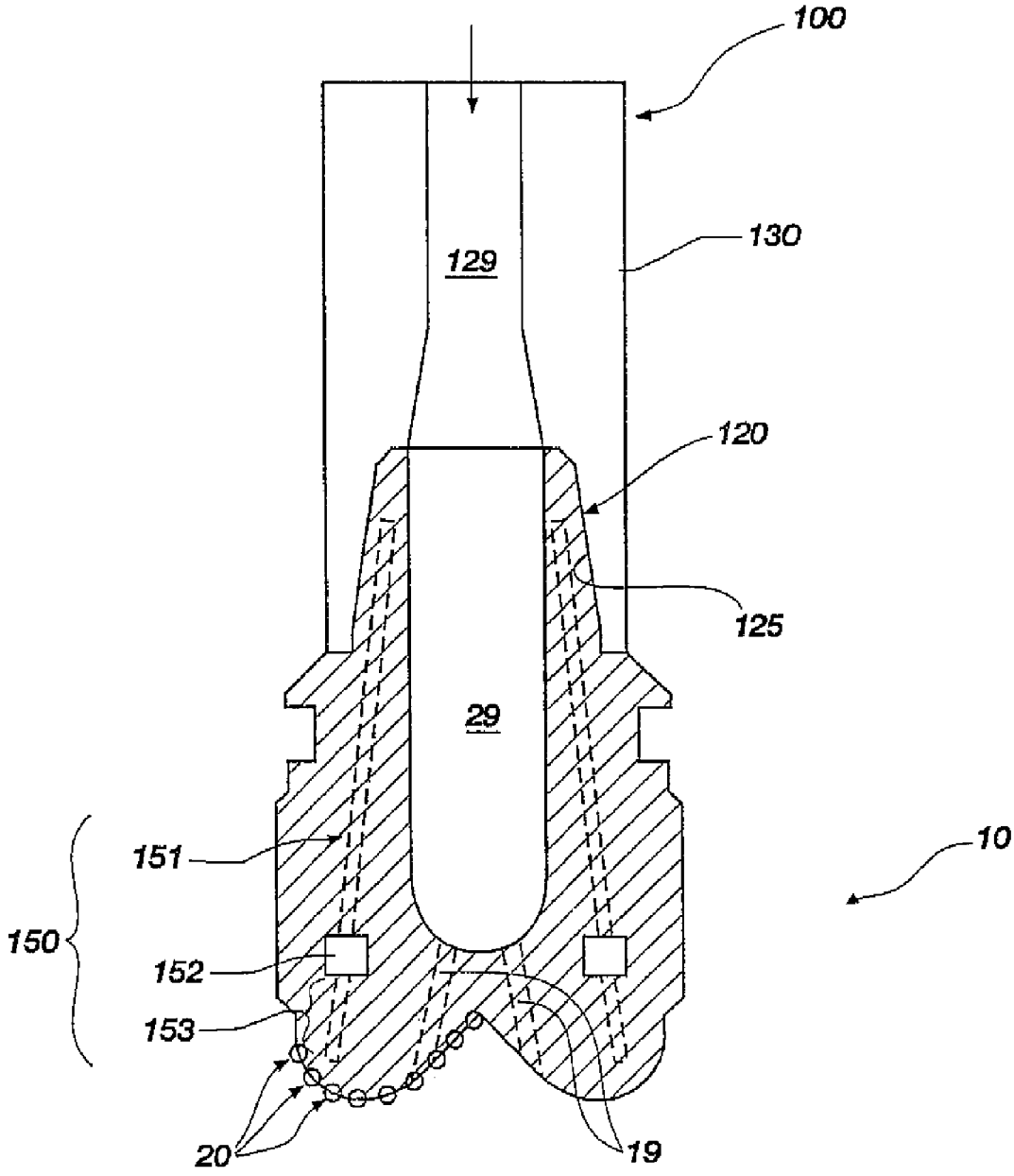
FIG. 7 shows a schematic, side cross-sectional view of another embodiment of a subterranean drilling assembly including a heat-conducting plenum.

In another embodiment, a heat-conducting structure may comprise at least one of the following: at least one heat-conducting member, at least one heat-conducting plenum, and at least one heat-conducting extension region. Such a configuration may preferentially or selectively transfer heat away from a selected region or portion of a subterranean drill bit (e.g., at least one cutting element). For example, FIG. 7 shows a schematic, side cross-sectional view of an assembly including a sub apparatus 100 and a subterranean drill bit 10, wherein the subterranean drill bit 10 includes a heat-conducting element 150 comprising at least one heat-conducting member 151, at least one heat-conducting plenum 152, and at least one heat-conducting extension region 153. As shown in FIG. 7, heat-conducting member 151 may extend from proximate sub coupling surface 120 to heat-conducting plenum 152. In addition, heat-conducting extension region 153 may extend from proximate at least one cutting element 20 to heat-conducting plenum 152. Thus, heat-conducting plenum 152 may be structured for providing a thermal path between heat-conducting member 151 and heat-conducting extension region 153. Put another way, heat-conducting plenum 152 may form a heat-conducting path (i.e., exhibiting a relatively high thermal conductivity) through which heat may be transferred via heat-conducting extension region 153 as well as heat-conducting member 151. Such a configuration may provide for flexibility in manufacturing a subterranean drill bit 10 that is structured for preferentially cooling at least one region of the subterranean drill bit 10.

Figure 8:
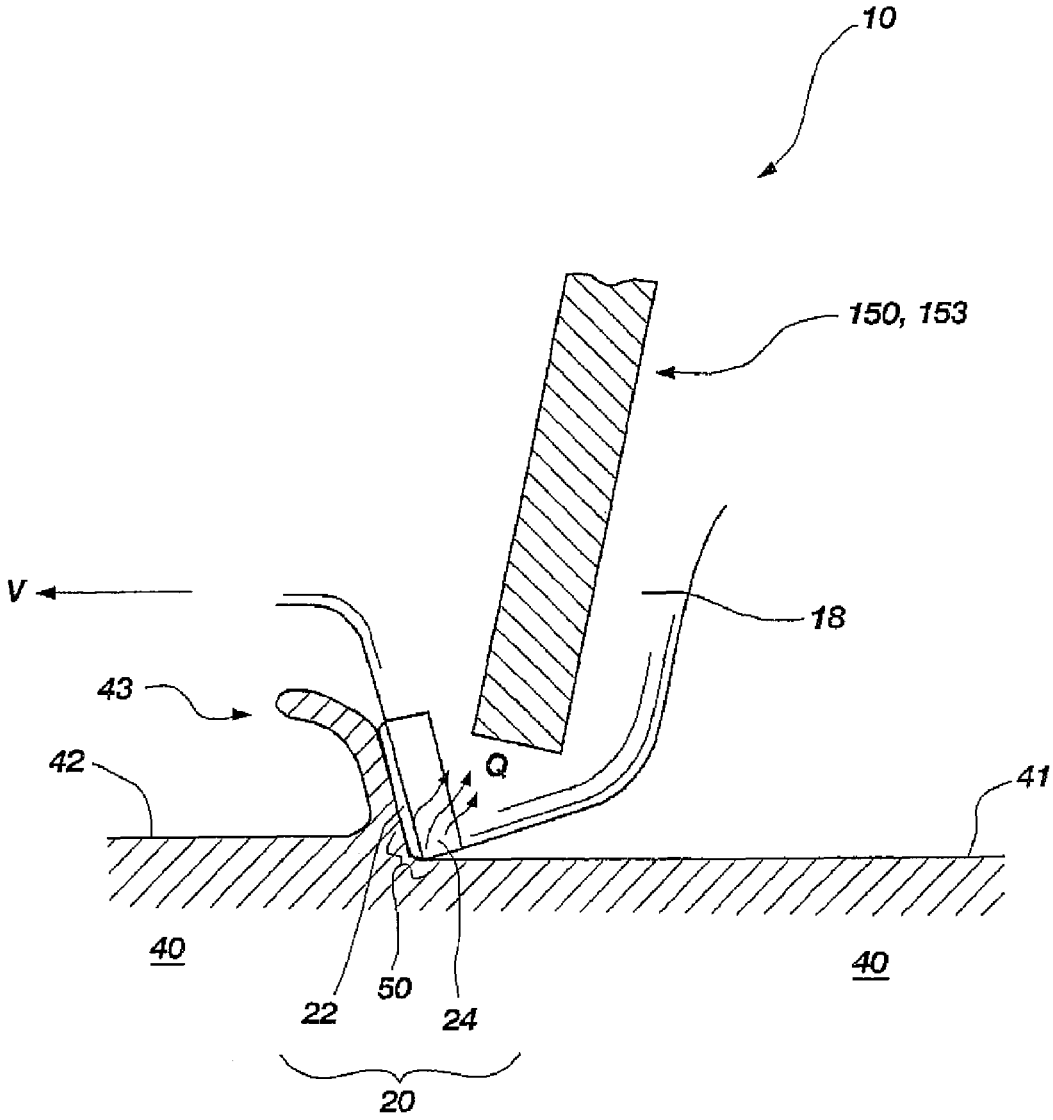
FIG. 8 shows a partial, schematic, side cross-sectional view of a cutting element affixed to a subterranean drill bit during use, wherein a heat-conducting structure is positioned proximate to the cutting element.
Figure 9:
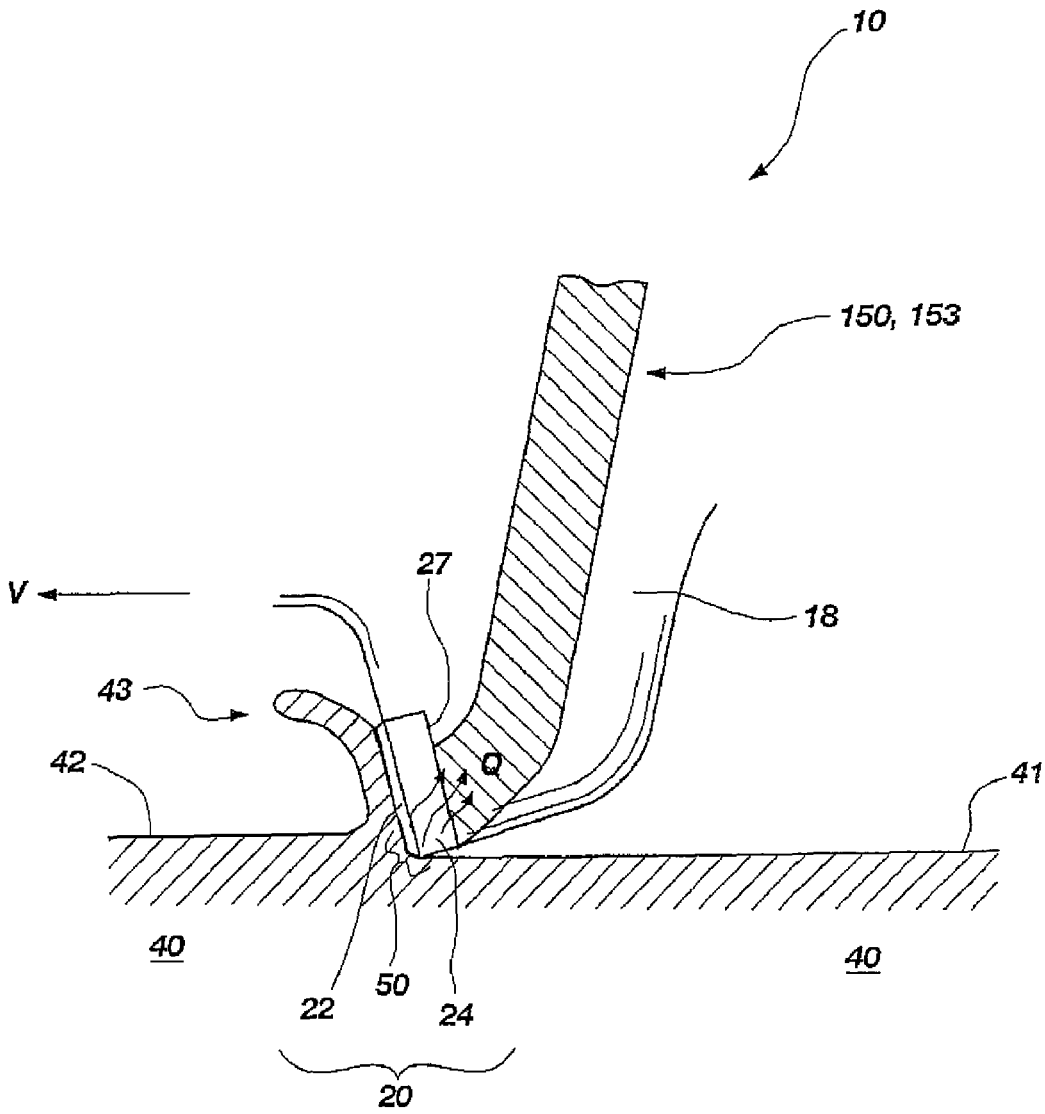
FIG. 9 shows a partial, schematic, side cross-sectional view of a cutting element affixed to a subterranean drill bit during use, wherein a heat-conducting structure abuts at least a portion of the cutting element.

As may be appreciated, it may be advantageous to provide preferential cooling to at least one cutting element affixed to a subterranean drill bit. More particularly, it may be advantageous to position at least a portion of a heat-conducting structure in proximity to a region of a cutting element designed to cut a subterranean formation. For example, FIG. 8 shows a schematic, side cross-sectional view of a rotary drill bit blade 18 including a heat-conducting element 150 or extension region 153 positioned proximate to a cutting element 20. As shown in FIG. 8, cutting element 20 may comprise a superabrasive material (e.g., polycrystalline diamond, cubic boron nitride, silicon carbide, etc.) or structure bonded to a substrate 24. Further, cutting element 20 may be affixed to drill bit blade 18 via brazing or another mechanical coupling as known in the art. Accordingly, during use, bit blade 18 may be rotated, under weight on bit, into subterranean formation 40. More specifically, a portion of subterranean formation 40 may be removed (i.e., a depth of cut defined by the difference between surface 42 of subterranean formation 40 and surface 41 of subterranean formation 40) in the form of cuttings 43, which may be transferred away from a subterranean drill bit via drilling fluid, as known in the art. Therefore, as shown in FIG. 8, an engagement region 50 of cutting element 20 may generate a majority, if not more, of the heat "Q" generated by cutting element 20 through cutting interaction with subterranean formation 40. In another embodiment, a heat-conducting structure (e.g., a heat-conducting element 150 or extension region 153) may contact at least a portion of cutting element 20. More particularly, FIG. 9 shows a schematic, side cross-sectional view of a bit blade 18 including a heat-conducting element 150 or extension region 153 that abuts or at least partially contacts a back surface 27 of cutting element 20. Such a configuration may be effective in transferring heat "Q" from cutting element 20 to heat-conducting element 150 or extension region 153.

Figure 10:
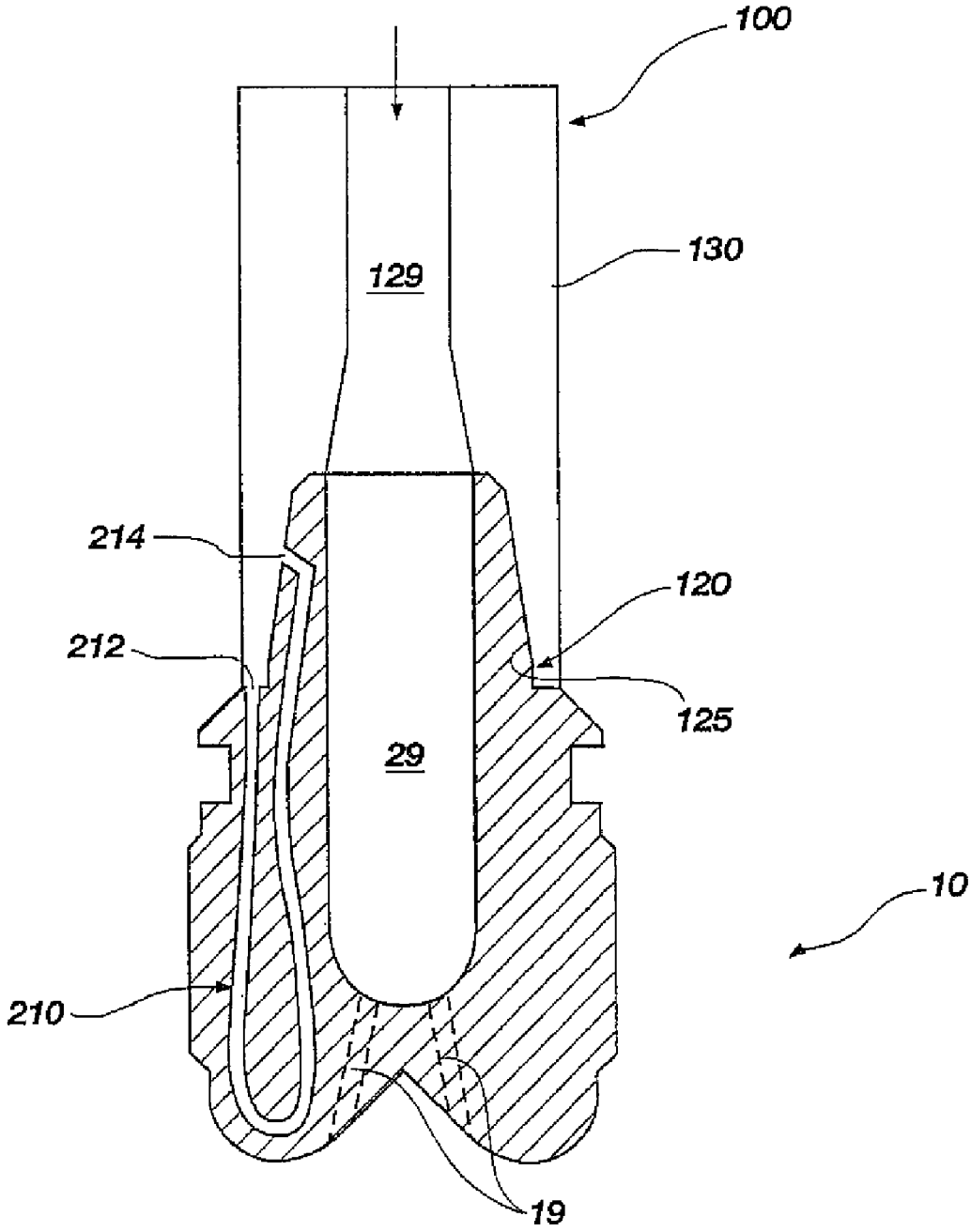
FIG. 10 shows a schematic, side cross-sectional view of a subterranean drilling assembly wherein a subterranean drill bit includes a fluid conduit configured to flow a refrigerated fluid therethrough.
Figure 11:
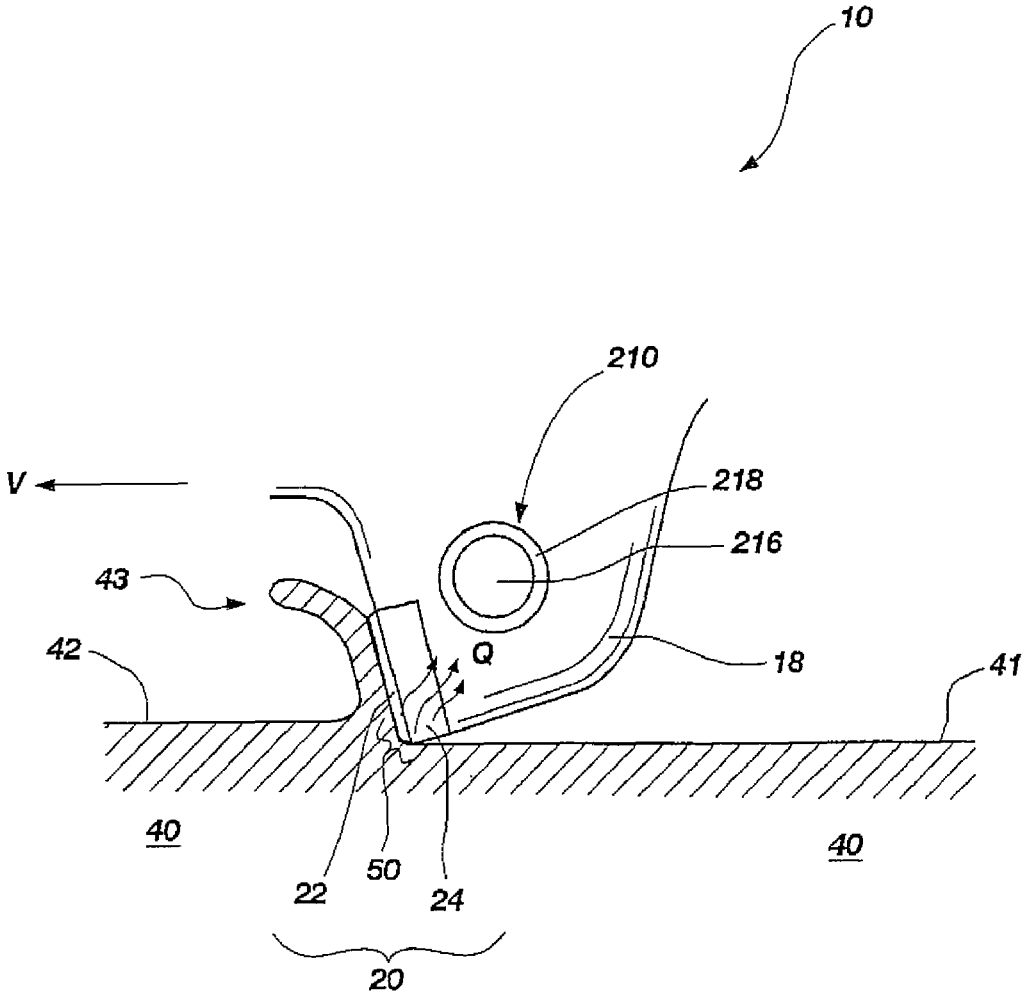
FIG. 11 shows a schematic, side cross-sectional view of a cutting element affixed to a subterranean drill bit during use, wherein a fluid conduit is positioned proximate to the cutting element.
Figure 12:
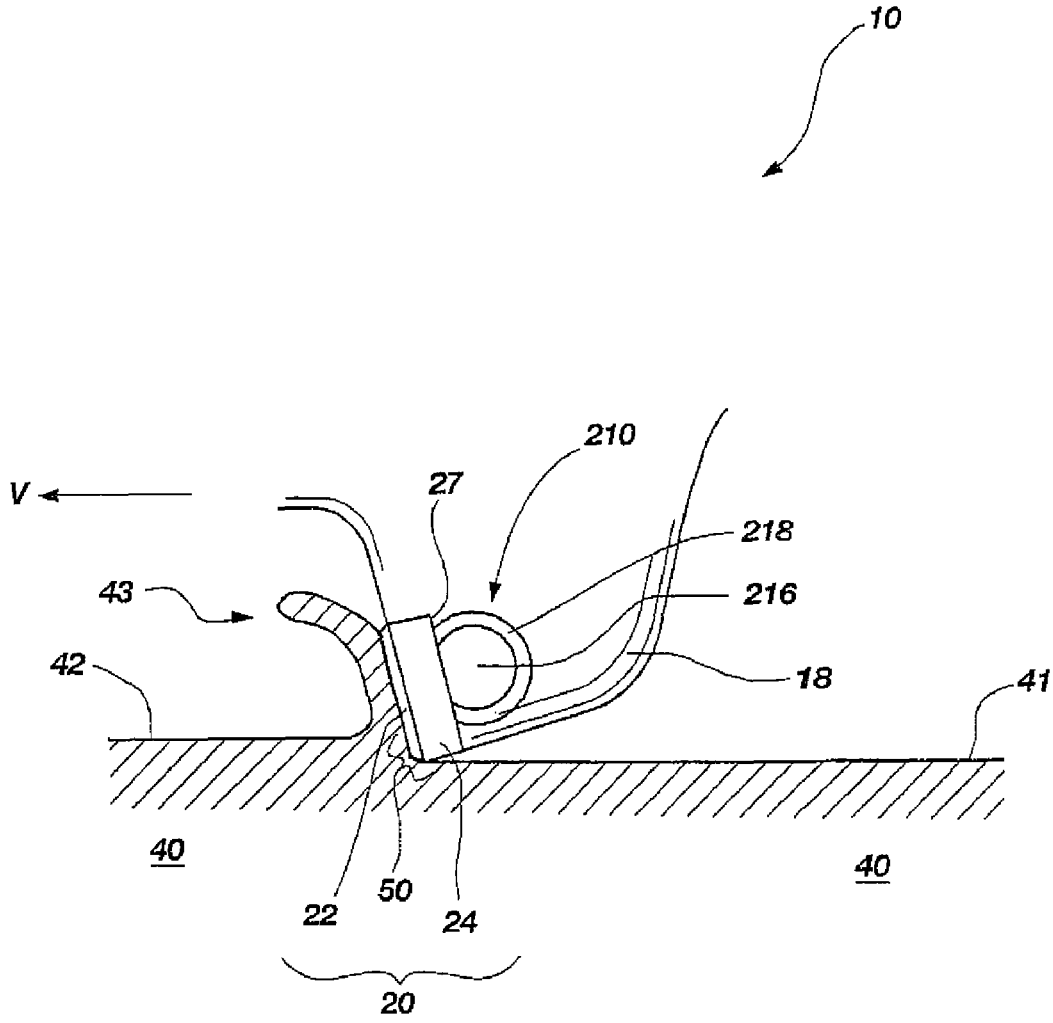
FIG. 12 shows a schematic, side cross-sectional view of a cutting element affixed to a subterranean drill bit during use, wherein a portion of a lumen defined by a fluid conduit positioned proximate to the cutting element is defined by the cutting element.

In a further aspect of the present invention, a refrigerated fluid may be circulated within a closed (i.e., not in fluid communication with the drilling fluid) refrigerant path that extends at least partially within a rotary drill bit. For example, FIG. 10 shows a schematic, side cross-sectional view of an assembly including a sub apparatus 100 and a subterranean drill bit 10, wherein the subterranean drill bit 10 includes a fluid conduit 210 configured for flowing a refrigerated fluid there through. Particularly, a refrigerated fluid may flow into conduit opening 212, through fluid conduit 210 and out of conduit opening 214 (or in an opposite flow direction, without limitation). Of course, an associated refrigeration system as well as fluid conducting lines or conduits may be included within sub apparatus 100 or may be located more remotely from subterranean drill bit 10. Put another way, sub apparatus 100 may be configured to facilitate operation of at least one cooling system positioned at least partially within subterranean drill bit 10. Such a configuration may provide a selected heat removal rate from one or more cutting elements affixed to the subterranean drill bit 10. In one embodiment, fluid conduit 210 may be positioned proximate at least one cutting element affixed to subterranean drill bit 10. For example, FIG. 11 shows a schematic, side-cross sectional view of a bit blade 18 including a fluid conduit 210. As shown in FIG. 11, fluid conduit 210 may comprise a tubular body 218 which defines a bore or lumen 216. Thus, a refrigerated fluid may be circulated within lumen 216 and may remove heat Q from cutting element 20 at a selected rate for maintaining a selected temperature of cutting element 20. In addition, properties, flow rate, and temperature of a refrigerated fluid flowing within lumen 216 of fluid conduit 210 may be selected and formulated to cause a desired heat transfer rate for a given temperature environment relating to cutting element 20. In another embodiment, at least a portion of a bore or lumen configured for conducting a refrigerated fluid may be formed by at least a portion of an exterior surface of a cutting element affixed to a subterranean drill bit. More specifically, FIG. 12 shows a schematic, side cross-sectional view of a bit blade 18 including a fluid conduit 210 comprising body 218. As shown in FIG. 12, lumen 216 may be defined by body 218 and a portion of back surface 27 of cutting element 20. Such a configuration may provide refrigerated fluid for convective heat transfer with at least a portion of a surface of cutting element 20.

Figure 13:
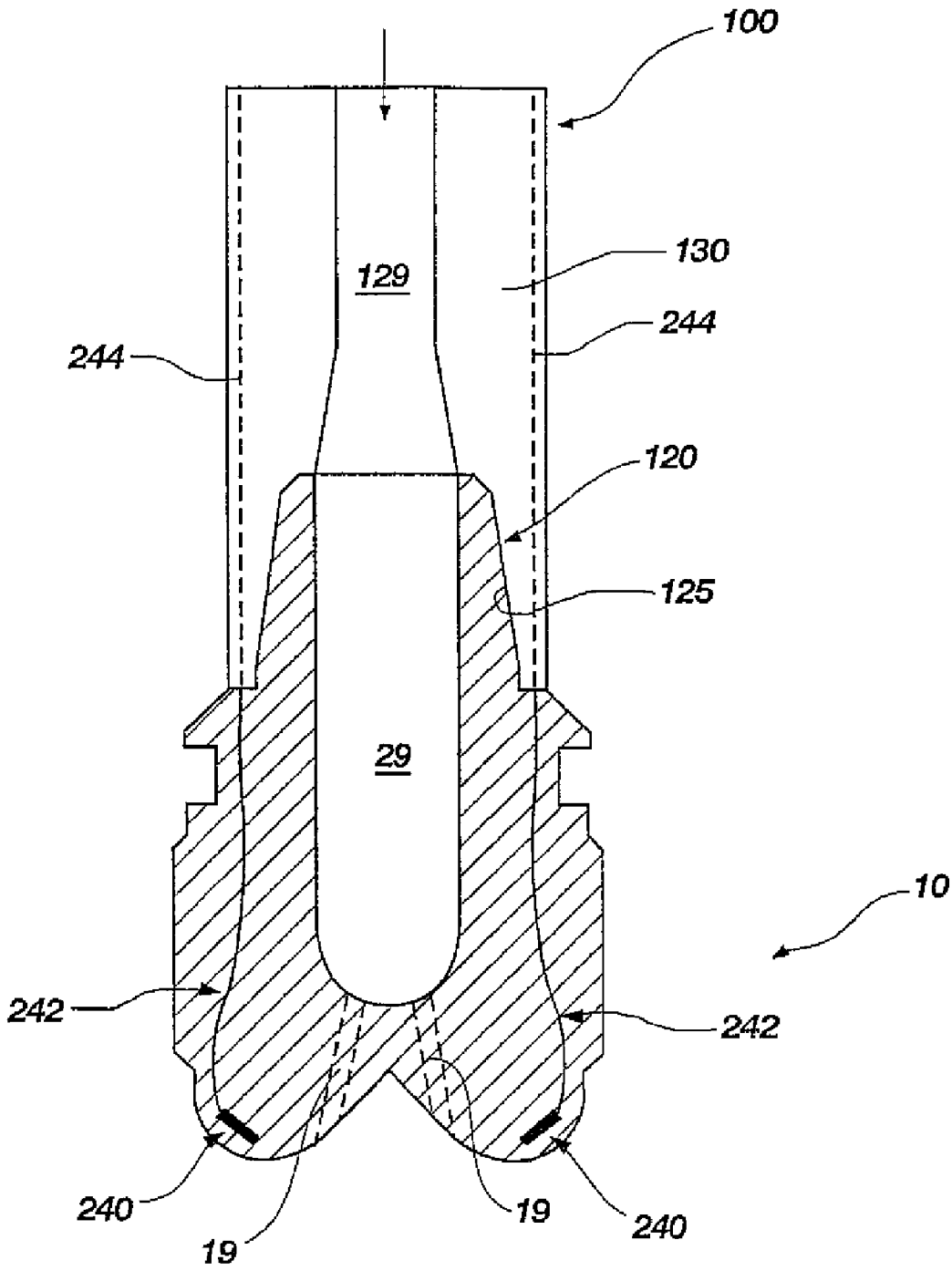
FIG. 13 shows a schematic, side cross-sectional view of a subterranean drilling assembly including a subterranean drill bit and a sub apparatus, wherein the subterranean drill bit comprises at least one thermoelectric device.

A further aspect of the present invention relates to a subterranean drill bit including at least one thermoelectric device. More specifically, the present invention contemplates that a subterranean drill bit may include at least one thermoelectric device positioned proximate to at least one cutting element affixed to the subterranean drill bit. FIG. 13 shows a schematic, side cross-sectional view of an assembly including a sub apparatus 100 and a subterranean drill bit 10, wherein the subterranean drill bit includes at least one thermoelectric device 240. One of ordinary skill in the art will understand that, for example, a subterranean drill bit may be fabricated from steel or a composite comprising tungsten carbide particles surrounded by a binder (e.g., a copper-based binder). Thus, a suitable recess or pocket may be formed within a steel or tungsten carbide drill bit for accommodating at least one thermoelectric device and any attendant electrical lines or connections. Further, sub apparatus 100 may be configured to facilitate operation of the at least one thermoelectric device positioned at least partially within subterranean drill bit 10. For example, sub apparatus 100 may include electrical power generation devices (turbines coupled to generators, batteries, etc.) that are electrically coupled to the at least one thermoelectric device.

Figure 14:
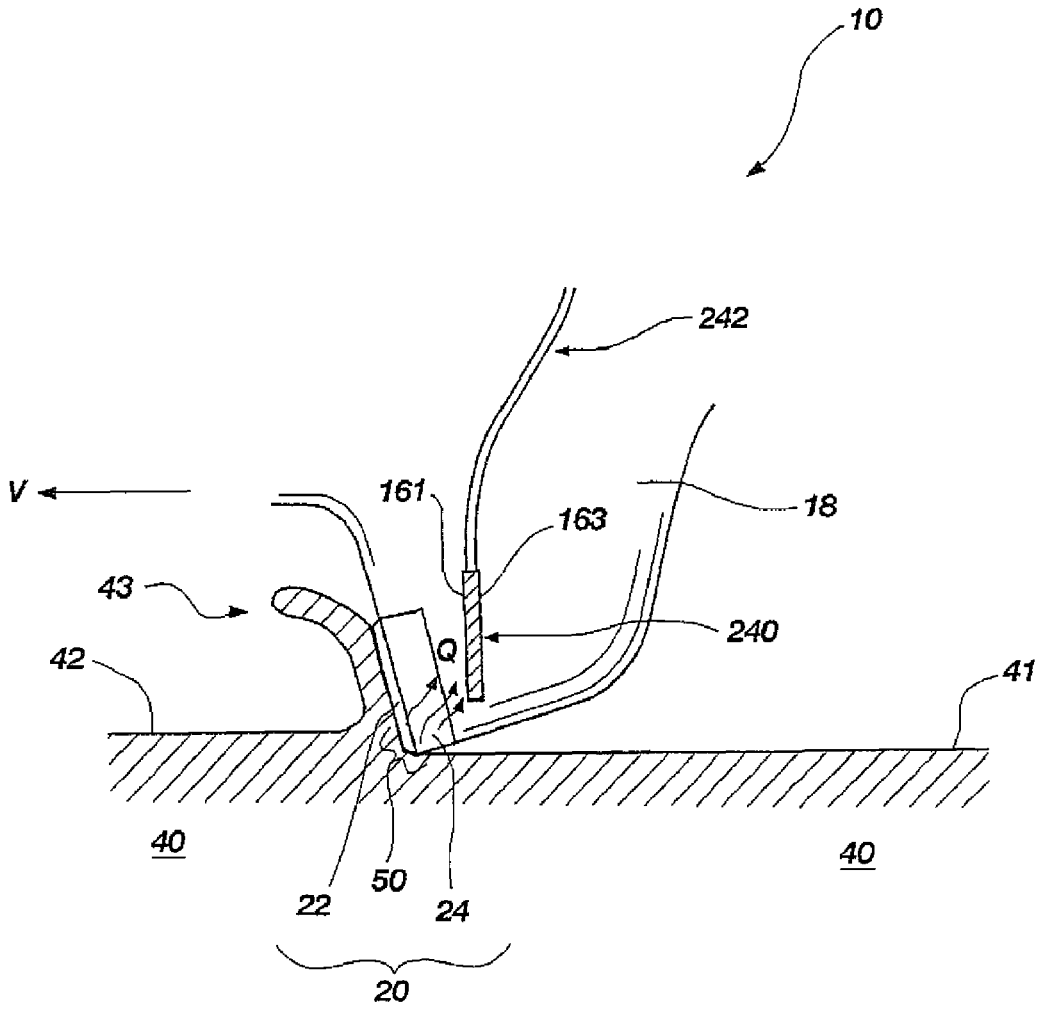
FIG. 14 shows a schematic, side cross-sectional view of a cutting element affixed to a subterranean drill bit during use, wherein a thermoelectric device is positioned proximate to the cutting element.

For example, as shown in FIG. 13, at least one thermoelectric device may be operably coupled to electrical lines 242, which extend within subterranean drill bit 10, and to electrical lines 244 extending within sub apparatus 100. Of course, such electrical lines 242, 244 may be operably coupled to an electrical power source (e.g., a downhole generator, a battery, etc.) suitable for providing a selected heat removal rate from subterranean drill bit 10. In further detail, in one embodiment, a thermoelectric device may be positioned proximate to a substrate of at least one cutting element for removing heat from the cutting element at a selected rate. FIG. 14 shows a schematic, side cross-sectional view of a drill bit blade 18 including a thermoelectric device 240 positioned proximate to substrate 24 of cutting element 20. Thus, heat generated by interaction of engagement region 50 with subterranean formation 40 may be transferred between cooled surface 161 of thermoelectric device 240 to heat-expelling surface 163 of thermoelectric device 240. One of ordinary skill in the art will understand that in another embodiment, a plurality of thermoelectric devices (as described with reference to FIG. 5B or as otherwise known in the art) may be positioned proximate a substrate of at least one cutting element for removing heat from the cutting element, if desired.

Figure 15:
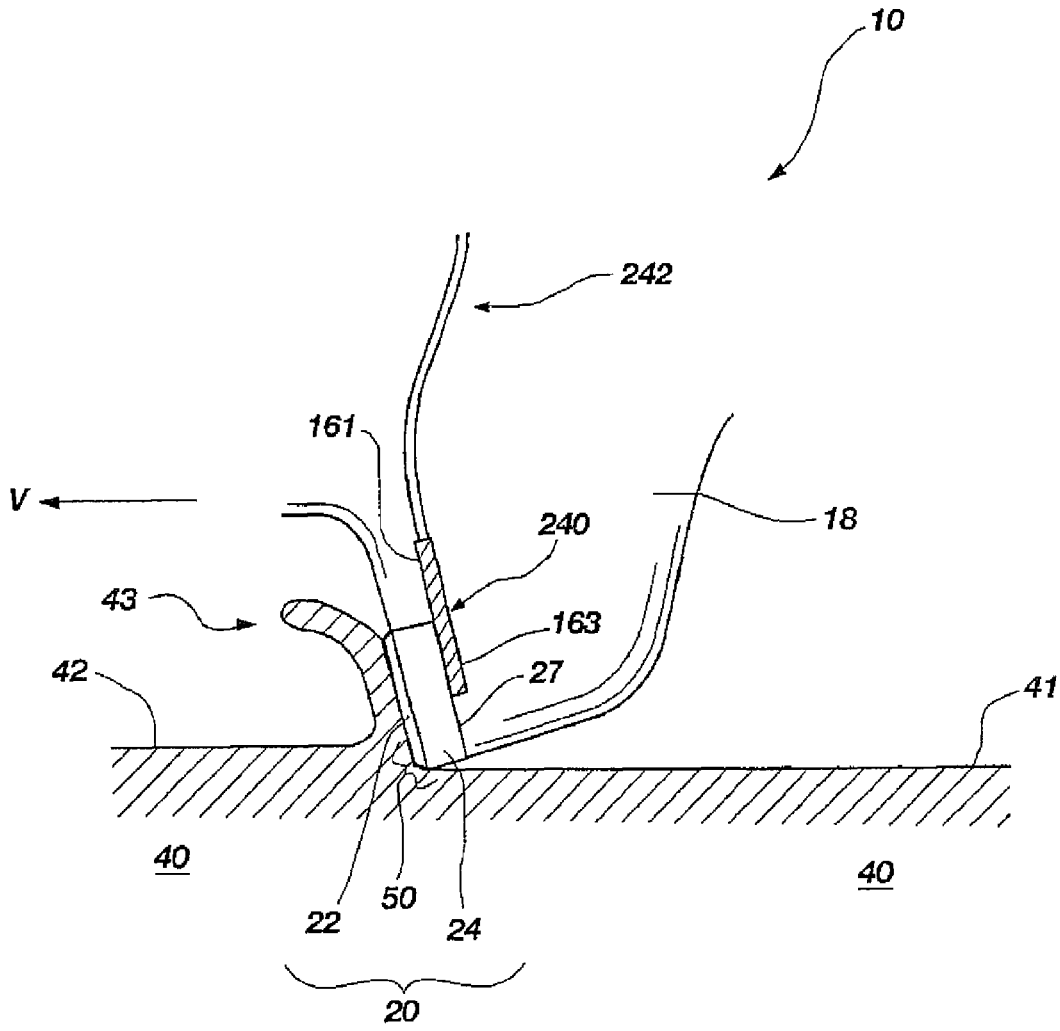
FIG. 15 shows a schematic, side cross-sectional view of a cutting element affixed to a subterranean drill bit during use, wherein a thermoelectric device abuts at least a portion of the cutting element.
Figure 16:
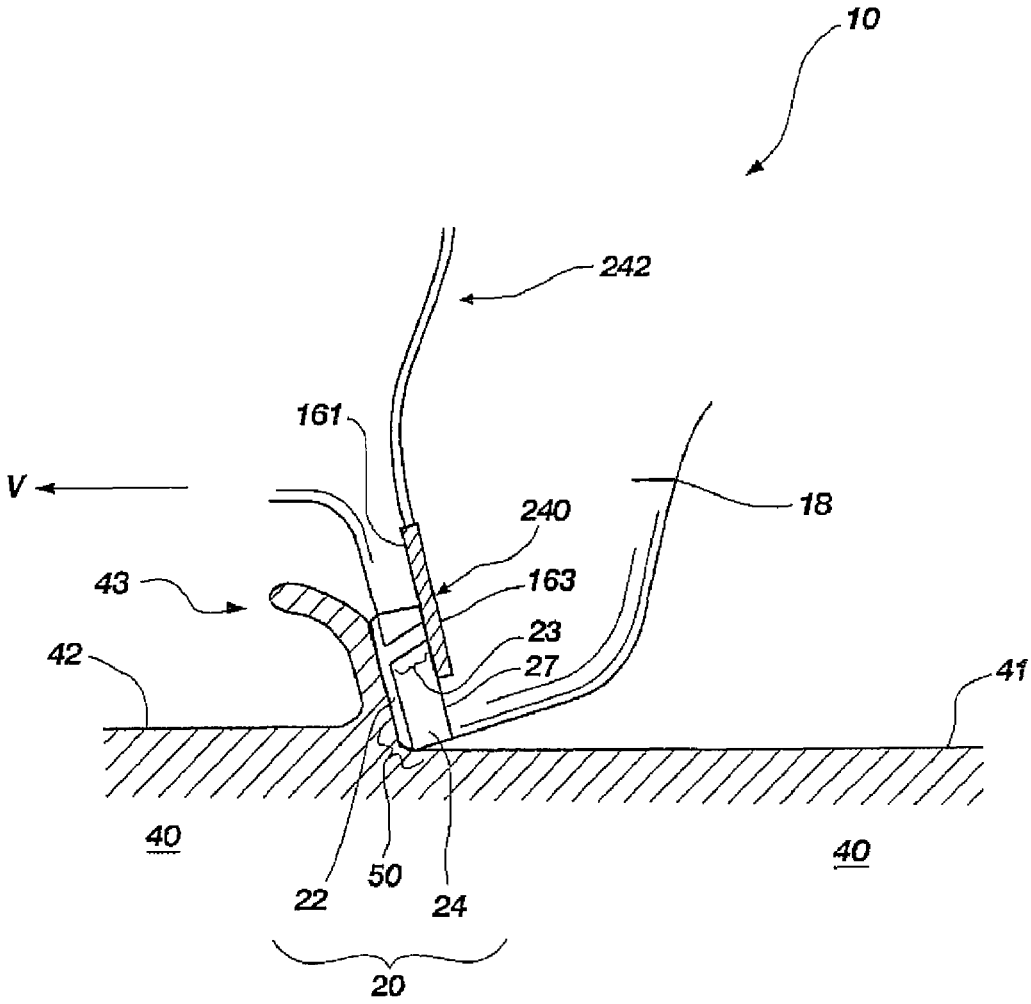
FIG. 16 shows a schematic, side cross-sectional view of a cutting element affixed to a subterranean drill bit during use, wherein a thermoelectric device abuts at least a portion of the cutting element and the cutting element includes a heat-conducting strut.

In a further embodiment, at least a portion of cooled surface 161 of thermoelectric device 240 may contact at least a portion of cutting element 20. For example, FIG. 15 shows a schematic, side cross-sectional view of a bit blade 18 of subterranean drill bit 10 including a thermoelectric device 240, wherein a cooled surface 161 of thermoelectric device 240 abuts or contacts at least a portion of back surface 27 of cutting element 20. Such a configuration may effectively remove heat from superabrasive table 22 (e.g., polycrystalline diamond, cubic boron nitride, silicon carbide, etc.) during drilling of subterranean formation 40. Of course, a heat-conducting structure may extend between a thermoelectric device and at least one cutting element to facilitate heat transfer between the at least one cutting element and the thermoelectric device. In an additional embodiment, a superabrasive, heat-conducting strut may extend between a superabrasive table and a heat removal device. For example, a polycrystalline diamond element may include a polycrystalline diamond strut extending from a polycrystalline diamond table and through a substrate of the cutting element to an exposed surface. Because polycrystalline diamond exhibits a relatively high thermal conductivity, such a polycrystalline diamond cutting element may exhibit, during cutting engagement with a subterranean formation, a lower temperature than conventional configurations. For example, FIG. 16 shows a schematic, side cross-sectional view of one embodiment of a bit blade 18 including a cutting element 20 that includes a heat-conducting strut 23 extending from superabrasive table 22 to back surface 27 of cutting element 20. Heat-conducting strut 23 may comprise a material exhibiting a relatively high thermal conductivity (e.g., gold, silver, copper, aluminum, carbon/graphite, natural or synthetic diamond, tungsten, or combinations of the foregoing, without limitation) to facilitate heat transfer between superabrasive table 22 and a heat removal device or system. More particularly, as shown in FIG. 16, heat-conducting strut 23 may extend between superabrasive table 22 and thermoelectric device 240. Accordingly, during cutting engagement of cutting element 20 with subterranean formation 40, heat may be transferred generally from engagement region 50 through superabrasive table 22 and heat-conducting strut 23 into cooled surface 161 of thermoelectric device 240. Of course, in other embodiments, heat-conducting strut 23 may be in contact with or proximate to a fluid conduit containing a refrigerated fluid. Furthermore, in yet an additional embodiment, heat-conducting strut 23 may be in direct contact with a refrigerated fluid (e.g., as in the embodiment discussed above in relation to FIG. 12). In yet another embodiment, heat-conducting strut 23 may be in direct contact with or proximate to a heat-conducting structure (e.g., a heat-conducting element 150 or extension region 153 as described above with reference to FIGS. 8 and 9) as discussed herein.

Figure 17:
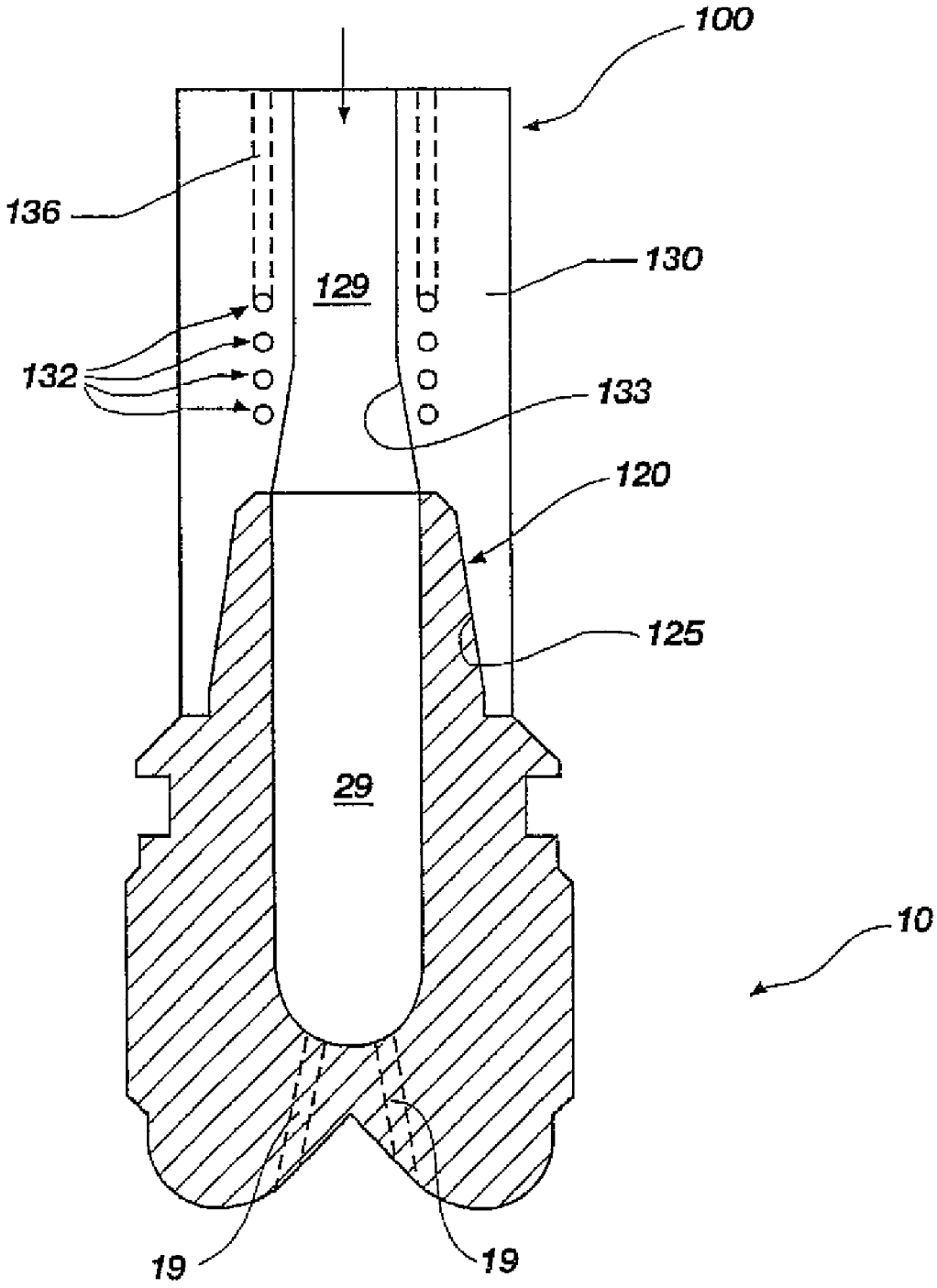
FIG. 17 shows a schematic, side cross-sectional view of a subterranean drilling assembly including a sub apparatus coupled to a subterranean drill bit, wherein the sub apparatus includes a cooling system for cooling a drilling fluid passing through the sub apparatus.

A further aspect of the present invention relates to cooling drilling fluids prior to flow through a subterranean drill bit. More specifically, the present invention contemplates that drilling fluid may be cooled or refrigerated proximate to a connection end of a subterranean drill bit. For example, FIG. 17 shows a schematic, side cross-sectional view of an assembly including a subterranean drill bit 10 and a sub apparatus 100, wherein the sub apparatus 100 includes refrigeration coils 132 configured to cool a drilling fluid passing through bore 129 of sub apparatus 100. Thus, drilling fluid passing through sub apparatus 100 and into bore 29 of subterranean drill bit 10 may remove heat from subterranean drill bit 10 and may pass through passages 19 to effect cooling upon at least one cutting element affixed to subterranean drill bit 10 as well as the exterior of subterranean drill bit 10. In another embodiment, one or more thermoelectric device may be positioned within sub apparatus 100 and may be configured for refrigerating a fluid passing through bore 129 and sub apparatus 100. As may be appreciated by one of skill in the art, refrigerating a drilling fluid proximate to a connection end of a subterranean drill bit may avoid thermal inefficiencies or losses that will occur if the drilling fluid is refrigerated at a greater distance from the subterranean drill bit. Put another way, such a configuration may avoid cooling a substantial portion of the drill string, which may avoid thermal losses or inefficiencies associated with cooling a substantial portion of the drill string.

Figure 18:
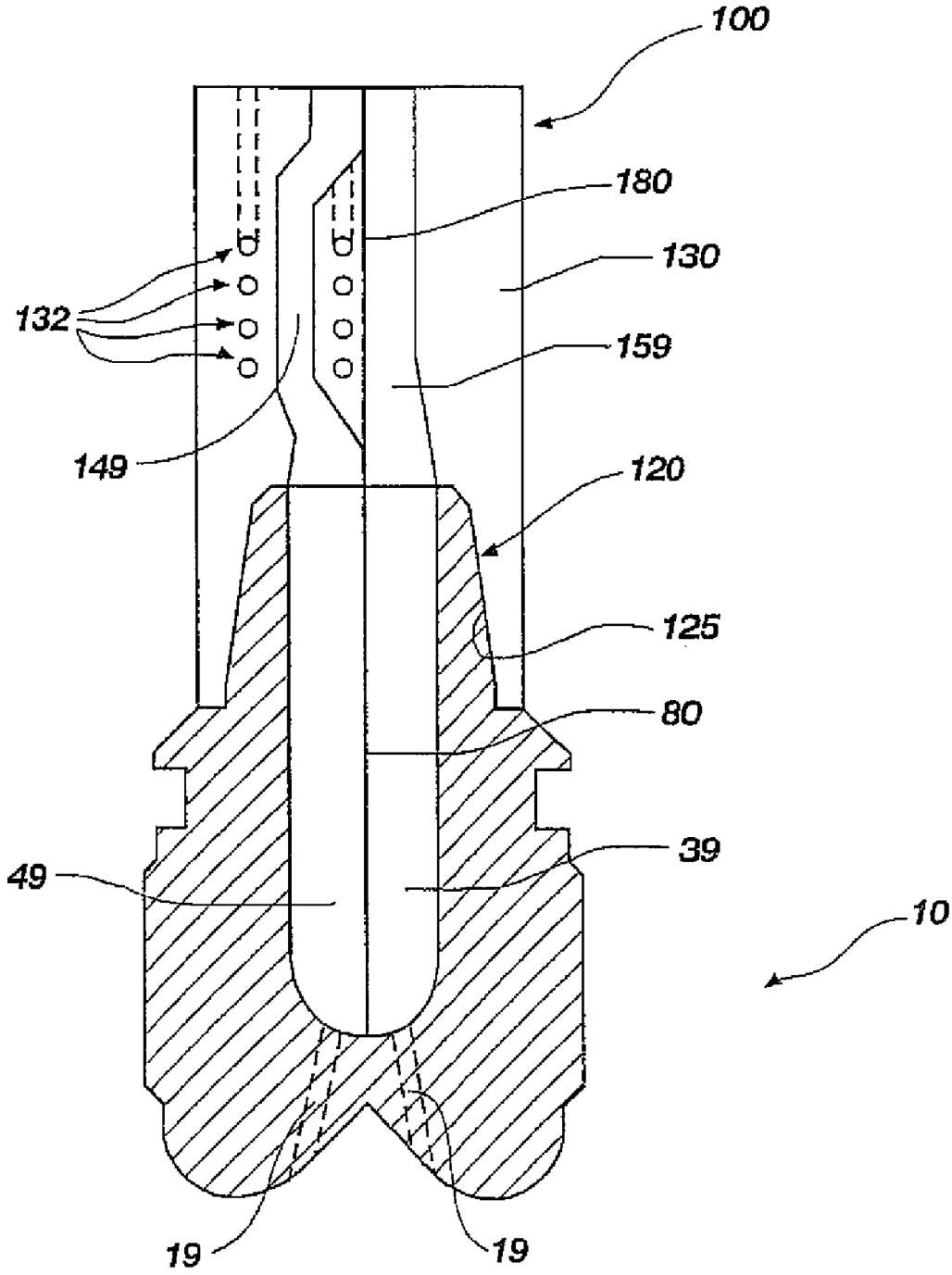
FIG. 18 shows a schematic, side cross-sectional view of a subterranean drilling assembly including a sub apparatus coupled to a subterranean drill bit, wherein the sub apparatus includes a cooling system for cooling a selected portion of drilling fluid passing through the sub apparatus.

In another embodiment, a drilling fluid flow stream may be split into a plurality of flow streams, wherein at least one of the plurality of drilling fluid flow streams is cooled. For example, FIG. 18 shows a schematic, side cross-sectional view of an assembly including sub apparatus 100 and subterranean drill bit, 10, wherein sub apparatus 100 and subterranean drill bit 10 are structured for splitting a drilling fluid flow stream into a plurality of flow streams. More particularly, as shown in FIG. 18, sub apparatus 100 includes bores 149, 159, which are separated, at least in part, by dividing wall 180 and subterranean drill bit 10 includes bores 49 and 39, which are separated, at least in part, by dividing wall 80. Thus, bore 149 of sub apparatus 100 may be in fluid communication with bore 49 of subterranean drill bit 10, while bore 159 of sub apparatus 100 may be in fluid communication with bore 39 of subterranean drill bit 10. Furthermore, as shown in FIG. 18, at least a portion of bore 149 may be refrigerated via refrigeration coils 132 positioned in the walls of sub apparatus 100. Summarizing, a plurality of flow streams from flowing drilling fluid through bores 149 and 159 and the flow stream of drilling fluid flowing through bore 149 may be refrigerated. Accordingly, a drilling fluid flow stream flowing through bore 49 of subterranean drill bit 10 may also be refrigerated. Passageway 19 may be in fluid communication with bore 49 of subterranean drill bit 10 and may be structured (e.g., sized, positioned, oriented, etc.) for cooling at least one selected cutting element affixed to subterranean drill bit 10 or a selected region (e.g., a region including at least one cutting element that exhibits, during use, a comparatively high work rate or heat generation). As may be appreciated by one of skill in the art, refrigerating or cooling a selected portion of a drilling fluid flow stream may result in relatively efficient and effective cooling for at least one cutter affixed to a subterranean drill bit.

Also, it should be understood that although embodiments of a rotary drill bit employing at least one cooling apparatus or system of the present invention are described above, the present invention is not so limited. Rather, the present invention contemplates that a drill bit (as described above) may represent any number of earth-boring tools or drilling tools, including, for example, core bits, roller-cone bits, fixed-cutter bits, eccentric bits, bicenter bits, reamers, reamer wings, or any other device or downhole tool including at least one cutting element or insert, without limitation. Further, one of ordinary skill in the art will appreciate that any of the above-described embodiments may be implemented with respect to a cutting element used for machining or other cutting operation (e.g., a lathe, a so-called planer, or other machining operation for cutting a material). Thus, one of ordinary skill in the art will appreciate that FIGS. 8, 9, 11, 12, and 14-16 may represent a cutting element affixed or otherwise coupled to a base (e.g., described above as a bit blade) for use in machining (e.g., by lathe, planer, etc.) a material (e.g., rock or stone, metals, etc. without limitation).

One of ordinary skill in the art will understand that removing heat from at least one cutting element coupled to a drill bit or at least one cutting element coupled to equipment for machining may significantly prolong the life of such at least one cutting element. Advantageously, this configuration may keep the engagement region between the cutting element and the material being drilled or machined much cooler. Such a configuration may also advantageously maintain the cutting edge of the cutting element, resulting in increased cutting efficiency for a longer period of use. Potentially, such a configuration may enable the drilling or machining of various materials (e.g., subterranean formations) that have not been previously drillable or machinable by conventional methods and devices.

Further, while specific cooling devices have been described (e.g., refrigeration systems, thermoelectric devices, heat pipes, thermosyphon systems, etc.) one of ordinary skill in the art will appreciate that other devices for transporting, transferring, and/or removing heat may be utilized without departing from the scope of the present invention. Thus, generally, while certain embodiments and details have been included herein and in the attached invention disclosure for purposes of illustrating the invention, it will be apparent to those skilled in the art that various changes in the methods and apparatus disclosed herein may be made without departing form the scope of the invention, which is defined in the appended claims. The words "including" and "having," as used herein, including the claims, shall have the same meaning as the word "comprising."

What is claimed is:

1. A subterranean drilling assembly comprising:

a bit body defining a plurality of central bores configured to communicate drilling fluid;

at least one cutting element fixedly coupled to the bit body;

a sub apparatus coupled to the subterranean drill bit body, wherein the sub apparatus includes a plurality of central bores that correspond to the central bores of the bit body, each of the plurality of central bores of the sub apparatus extending substantially through an entire length of the sub apparatus and being configured to maintain any fluid flowing therethrough separate from any other bore of the plurality of central bores while flowing through the sub apparatus;

a cooling system configured to cool drilling fluid to be communicated through at least one of the plurality of central bores of the subterranean drill bit body while avoiding cooling drilling fluid to be communicated through at least another of the plurality of central bores of the subterranean drill bit body.

2. The subterranean drilling assembly of claim 1, wherein the at least one cooling system comprises a plurality of refrigeration coils.

3. The subterranean drilling assembly of claim 1, wherein the at least one cooling system comprises at least one thermoelectric device.

4. The subterranean drilling assembly of claim 1, further comprising an opening formed in a surface of the drill bit body in communication with at least one bore of the plurality of central bores of the bit body.

5. The subterranean drilling assembly of claim 1, wherein at least one bore of the plurality of central bores in the sub apparatus include an opening at a first end positioned along an axis, an exit along a second end positioned along the axis, and a portion between the opening and the exit that deviates from the axis.

6. The subterranean drilling assembly of claim 1, wherein the at least one cutting element includes a substrate and a superabrasive table coupled with the substrate.

7. The subterranean drilling assembly of claim 6, wherein the at least one cutting element includes a heat-conducting strut extending from the superabrasive table through the substrate.

8. The subterranean drilling assembly of claim 7, wherein the heat-conducting strut is formed of a material comprising at least one of gold, silver, copper, aluminum, tungsten, graphite or diamond.

9. A method of operating a subterranean drill bit, the method comprising:

providing a subterranean drill bit, wherein the subterranean drill bit includes a bit body having at least one cutting element fixedly coupled with the bit body and a plurality of central bores through the bit body configured to communicate drilling fluid;

coupling the subterranean drill bit with a sub apparatus having a plurality of central bores such that each of the plurality of central bores of the sub apparatus extends substantially through an entire length of the sub apparatus and corresponds with an associated one of the plurality of central bores of the subterranean drill bit;

providing a cooling system;

flowing a first mass of drilling fluid through a first bore of the plurality of central bores;

flowing a second mass of drilling fluid through a second bore of the plurality of central bores;

maintaining the first mass of drilling fluid and the second mass of drilling fluid separate from each other throughout their respective flow paths through the sub apparatus; and cooling the first mass of drilling fluid with the cooling system.

10. The method of claim 9, further comprising flowing the first mass of drilling fluid through at least one passageway defined within the bit body, the first mass of drilling fluid exiting an opening positioned proximate to at least one cutting element affixed to the subterranean drill bit.

11. The method of claim 10, further comprising flowing the second mass of drilling fluid through at least one other passageway defining within the bit body, the second mass of drilling fluid exiting another opening formed in the drill bit body.

12. The method of claim 9, wherein flowing the first mass of drilling fluid through the first bore the plurality of central bores includes flowing the first mass of drilling fluid through a first portion of the first bore that extends along a first axis, flowing the first mass of drilling fluid through a second portion of the first bore that deviates from the first axis, and flowing the first mass of drilling fluid through a third portion of the first bore along the first axis to exit the sub apparatus and enter the drill bit body.

13. The method of claim 9, further comprising forming the at least one cutting element to include a substrate and a superabrasive table coupled with the substrate.

14. The method of claim 13, further comprising forming the at least one cutting element to include a heat-conducting strut extending from the superabrasive table through the substrate.

15. The method of claim 13, further comprising forming the heat conducting strut of a material comprising at least one of gold, silver, copper, aluminum, tungsten, graphite or diamond.

* * * * *